US007059697B2

(12) United States Patent
Takahashi et al.

(10) Patent No.: US 7,059,697 B2
(45) Date of Patent: Jun. 13, 2006

(54) INK JET PRINTING APPARATUS AND INK JET PRINTING METHOD

(75) Inventors: Seiji Takahashi, Kanagawa (JP); Yasuhiko Ikeda, Kanagawa (JP); Hiroyuki Niimura, Kanagawa (JP); Kota Uchida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/130,260

(22) Filed: May 17, 2005

(65) Prior Publication Data

US 2005/0206666 A1 Sep. 22, 2005

Related U.S. Application Data

(62) Division of application No. 10/649,658, filed on Aug. 28, 2003.

(30) Foreign Application Priority Data

Aug. 30, 2002 (JP) ..... 2002-255903

(51) Int. Cl.
*B41J 25/308* (2006.01)

(52) U.S. Cl. ..... 347/8; 400/55; 400/56

(58) Field of Classification Search ..... 347/8; 400/55–60

See application file for complete search history.

(56) References Cited

U.S. PATENT DOCUMENTS

| | | | | |
|---|---|---|---|---|
| 6,318,836 | B1 | 11/2001 | Hasegawa et al. | 347/33 |
| 6,419,409 | B1 | 7/2002 | Ueda et al. | |
| 6,834,925 | B1 | 12/2004 | Ikeda | |
| 6,869,235 | B1 * | 3/2005 | Kawaguchi et al. | 400/59 |
| 2002/0057301 | A1 * | 5/2002 | Ikeda | 347/8 |
| 2004/0041880 | A1 | 3/2004 | Ikeda et al. | |
| 2004/0062587 | A1 | 4/2004 | Uchida et al. | |

FOREIGN PATENT DOCUMENTS

JP 2002-137487 5/2002

* cited by examiner

*Primary Examiner*—Stephen Meier
*Assistant Examiner*—Ly T. Tran
(74) *Attorney, Agent, or Firm*—Fitzpatrick, Cella, Harper & Scinto

(57) ABSTRACT

The present invention provides an ink jet printing apparatus of a low-cost and simple construction which can detect with high reliability a gap between a print medium and a print head mounted on a carriage. The ink jet printing apparatus, which reciprocally moves in a predetermined scan direction the carriage holding the print head for ejecting ink onto the print medium, includes a gap changing mechanism for changing the gap between the print head held in the carriage and the print medium and a control unit for controlling a driving of the gap changing mechanism and a reciprocal movement of the carriage, wherein the control unit drives the gap changing mechanism and reciprocally moves the carriage to check the operation state of the gap changing mechanism.

4 Claims, 40 Drawing Sheets

INK JET PRINTING APPARATUS AND INK JET PRINTING METHOD

This application claims priority from Japanese Patent Application No. 2002-255903 filed Aug. 30, 2002, which is incorporated hereinto by reference.

This application is a division of application Ser. No. 10/649,658 filed Aug. 28, 2003.

BACKGROUND OF THE INVENTION

Field of the Invention

The present invention relates to a printing apparatus that forms an image by reciprocating a carriage mounting a print head and more particularly to an ink jet printing apparatus and an ink jet printing method capable of using a relatively thick print material such as a tray accommodating a compact disc.

Description of the Related Art

Ink Jet printing apparatus are currently being applied not only to rectangular sheets of paper or strips of rolled paper but also to other print materials having a variety of two-dimensional shapes and thicknesses. For example, even small and thick materials such as CD-Rs, DVDs and cards are printed with various images and characters by putting on their surfaces a print material suited for ink jet printing and printing images and characters there (in the following, these materials to be printed on are generally called compact discs (CDs).

In conventional general-purpose ink jet printing apparatus, when a material such as a CD is to be printed, if a general transport path for paper is used, various problems will arise, including poor feeding performance because of its high stiffness, the CD sustaining scores, and the CD failing to be transported because of a relatively long distance between feed rollers. To deal with these problems, the conventional apparatus use a dedicated path for a tray different from the general paper transport path.

Since trays have a greater thickness than that of general paper, the tray transport path is set almost horizontal and, from a standpoint of user's maneuverability, often configured to accept a tray from a front side of the printing apparatus as opposed to a back side from which paper is usually loaded. In this configuration, whether the tray is loaded in the transport path is usually not directly detected by a sensor. This is because the use of a configuration that enables detection of the presence or absence of a tray loaded from the opposite direction makes a reduction in size and cost of the apparatus difficult.

Meanwhile, in ink jet printing apparatus capable of printing such materials as CDs, an ink jet printing method that performs printing by scanning an ink ejecting print head mounted on a carriage along with the carriage is widely adopted. Thanks to many advantages, such as an ease with which an image can be formed in colors and at an increased resolution and low operation noise, the ink jet printing apparatus are in widespread use.

In such ink jet printing apparatus, setting a distance (or gap) between ink ejection openings in a print head and a print medium such as CD to an optimum value constitutes an important factor in forming a vivid and crisp image. When print media such as CDs are used in particular, since they are thicker than ordinary print media such paper and films, the print head must be set farther apart from a print medium support surface than when ordinary print media are used, to provide an optimum gap.

To provide an optimum gap between the print medium and the print head or ink ejection openings of the print head, it is common practice to change a position of a shaft that guides and supports a carriage mounting the print head according to the thickness of the print medium by activating a drive mechanism or eccentric cam provided on the shaft. In this case, the gap between the print head and the print medium is generally controlled by providing a rotary encoder or the like to a drive shaft of a pulse motor or DC motor, a drive source for the drive mechanism and eccentric cam, and controlling the motor according to a detected revolution of the drive shaft. The gap between the print head and the print medium is also controlled by using an optical or magnetic sensor that detects the gap.

These conventional techniques, however, have the following drawbacks.

(1) If a sensor for detecting the movement of a drive mechanism or for detecting the distance (gap) between a print medium, such as CD and tray, and the print head is provided to control the gap, it is difficult to minimize the cost of an ink jet printing apparatus.

(2) The provision of such a sensor requires a space and members for installing it and also lead wires for electrical connection of the sensor, making the inner construction of the printing apparatus complex and its size reduction difficult.

(3) If, to avoid the above problems, a dedicated sensor is not used, it is then not possible to check whether a gap control mechanism such as the one described above is working normally.

SUMMARY OF THE INVENTION

The present invention has been accomplished to overcome these problems experienced with the conventional art and provides an ink jet printing apparatus and an ink jet printing method which have a low-cost and simple construction and can detect with high reliability a gap between a print medium and a print head mounted on a carriage.

To solve the problems of the conventional art, the present invention has the following construction.

In a first aspect, the present invention provides a printing apparatus for printing a print medium with a print head, comprising: a carriage for mounting and moving the print head; a lift motor for changing a distance between the print head mounted on the carriage and the print medium; and a control unit for controlling a driving of the lift motor and a reciprocal movement of the carriage, wherein the control unit checks an operation of the lift motor by detecting a distance of travel of the carriage.

In a second aspect, the present invention provides a printing method for printing a print medium with a print head comprising the steps of: changing a distance between the print head mounted on a carriage and the print medium by a lift motor; detecting a distance of travel of the carriage by moving the carriage; and checking an operation of the lift motor according to the distance of travel of the carriage.

With this invention as described above, since a travel range changing unit for changing a travel range of the carriage in the main scan direction according to the vertical position of the carriage is provided and since the travel range of the carriage in the main scan direction is detected to determine whether the gap between the print head and the print medium is appropriate or not, the gap can be set at an appropriate size using a low-cost, small construction and the printing reliability can also be improved.

The above and other objects, effects, features and advantages of the present invention will become more apparent from the following description of embodiments thereof taken in conjunction with the accompanying drawings.

DETAILED DESCRIPTION OF PREFERRED EMBODIMENTS (First Embodiment)

Figure 1:
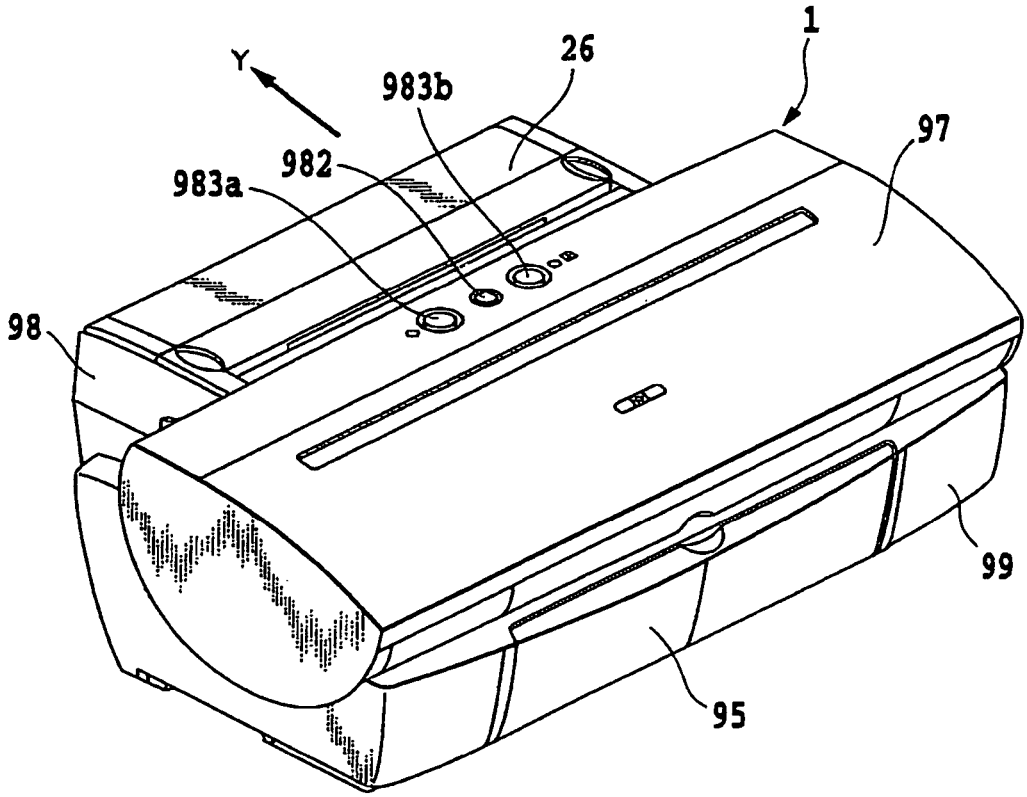
FIG. 1 is a perspective view of an ink jet printing apparatus as a first embodiment of the present invention.
Figure 2:
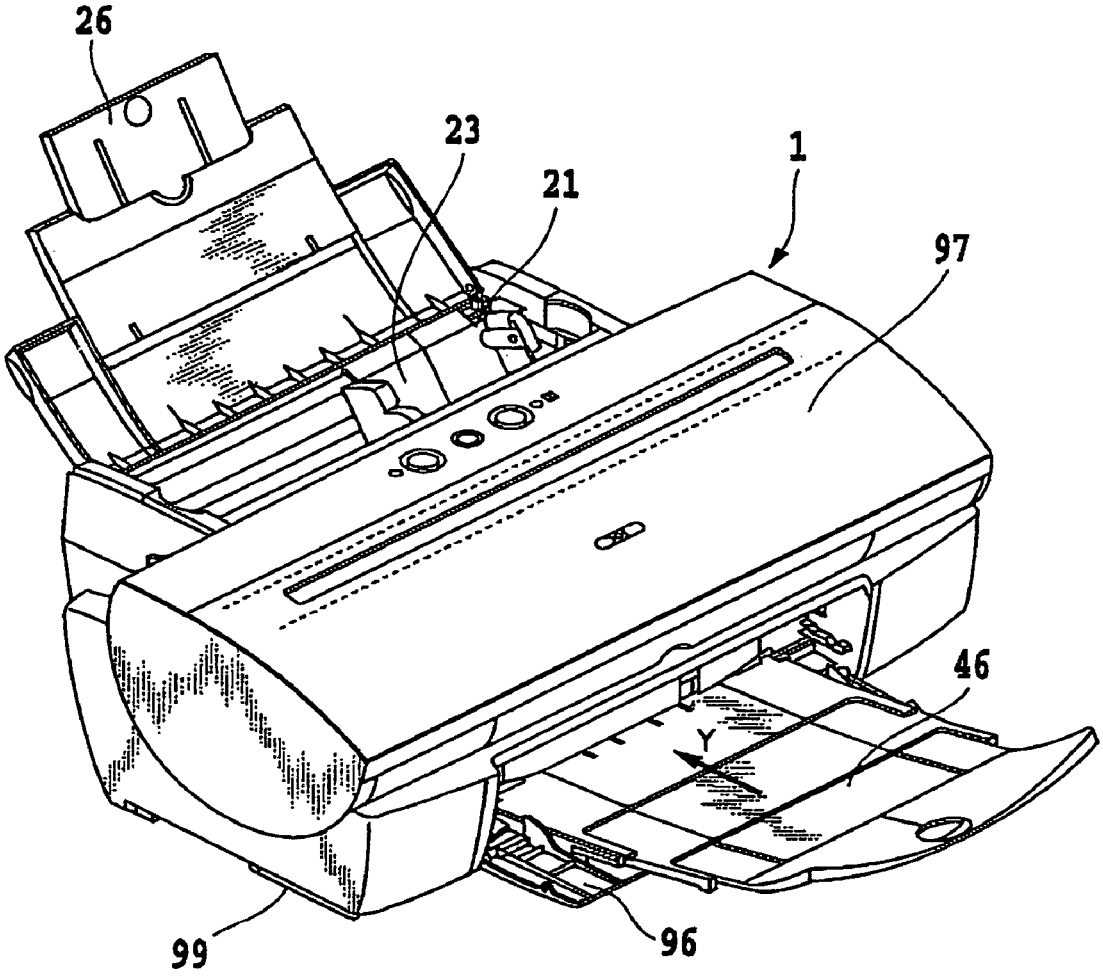
FIG. 2 is a perspective view of the ink jet printing apparatus in the first embodiment, with its front cover and paper supply tray open from the state of FIG. 1.
Figure 3:
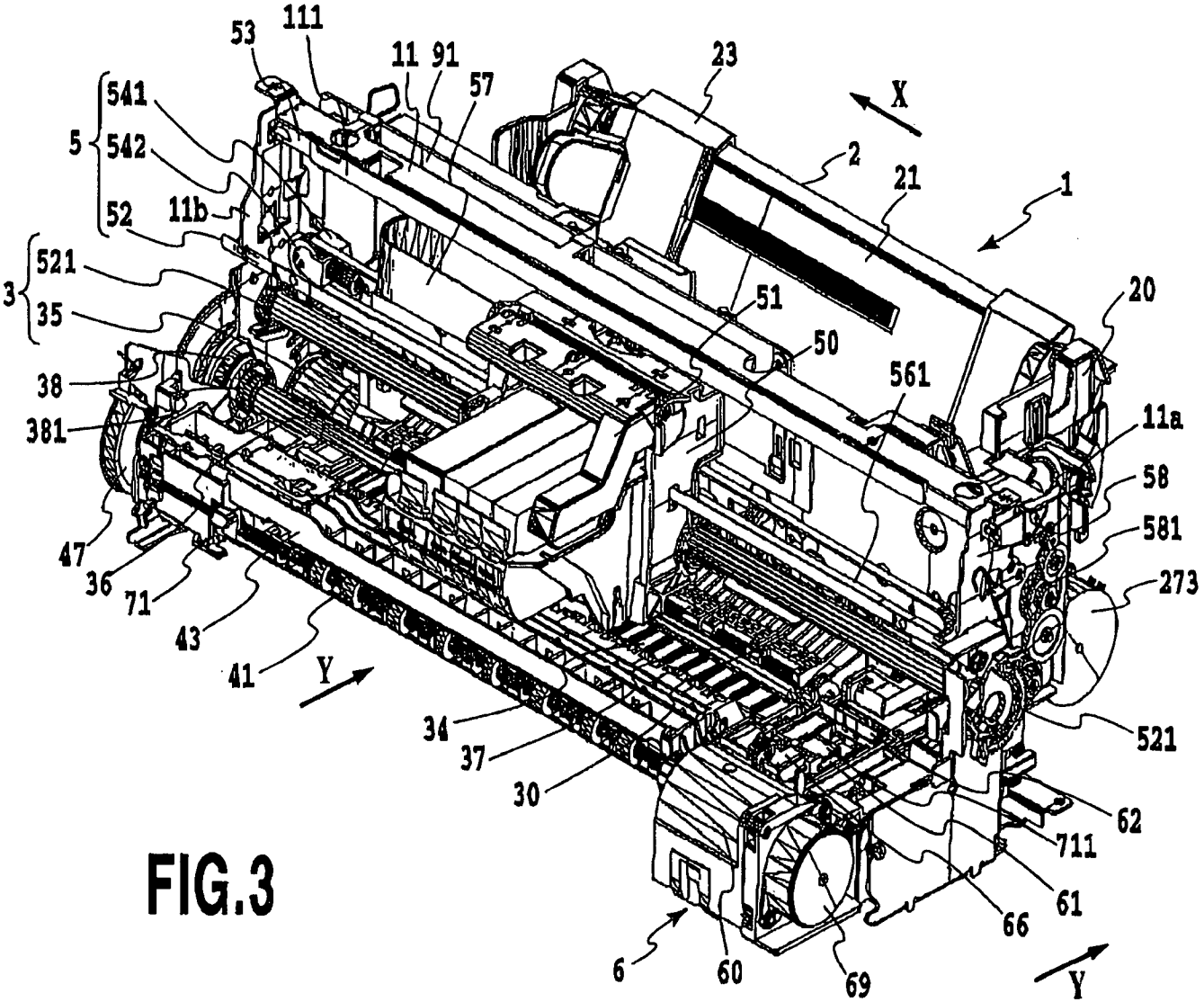
FIG. 3 is a perspective view of the ink jet printing apparatus in the first embodiment, showing a mechanical construction as seen from diagonally above on the right side.
Figure 4:
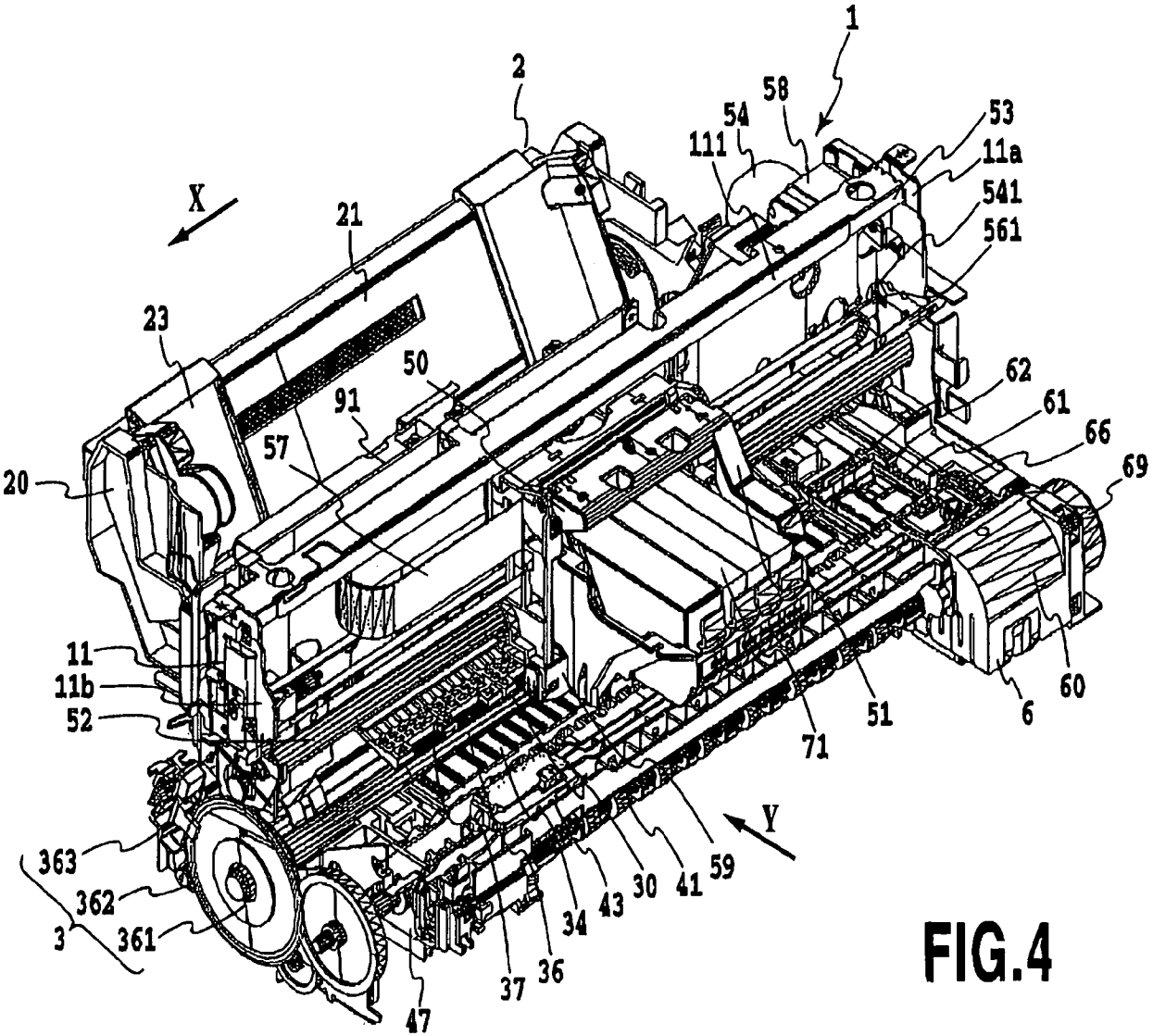
FIG. 4 is a perspective view of the ink jet printing apparatus in the first embodiment, showing the mechanical construction as seen from diagonally above on the left side.
Figure 5:
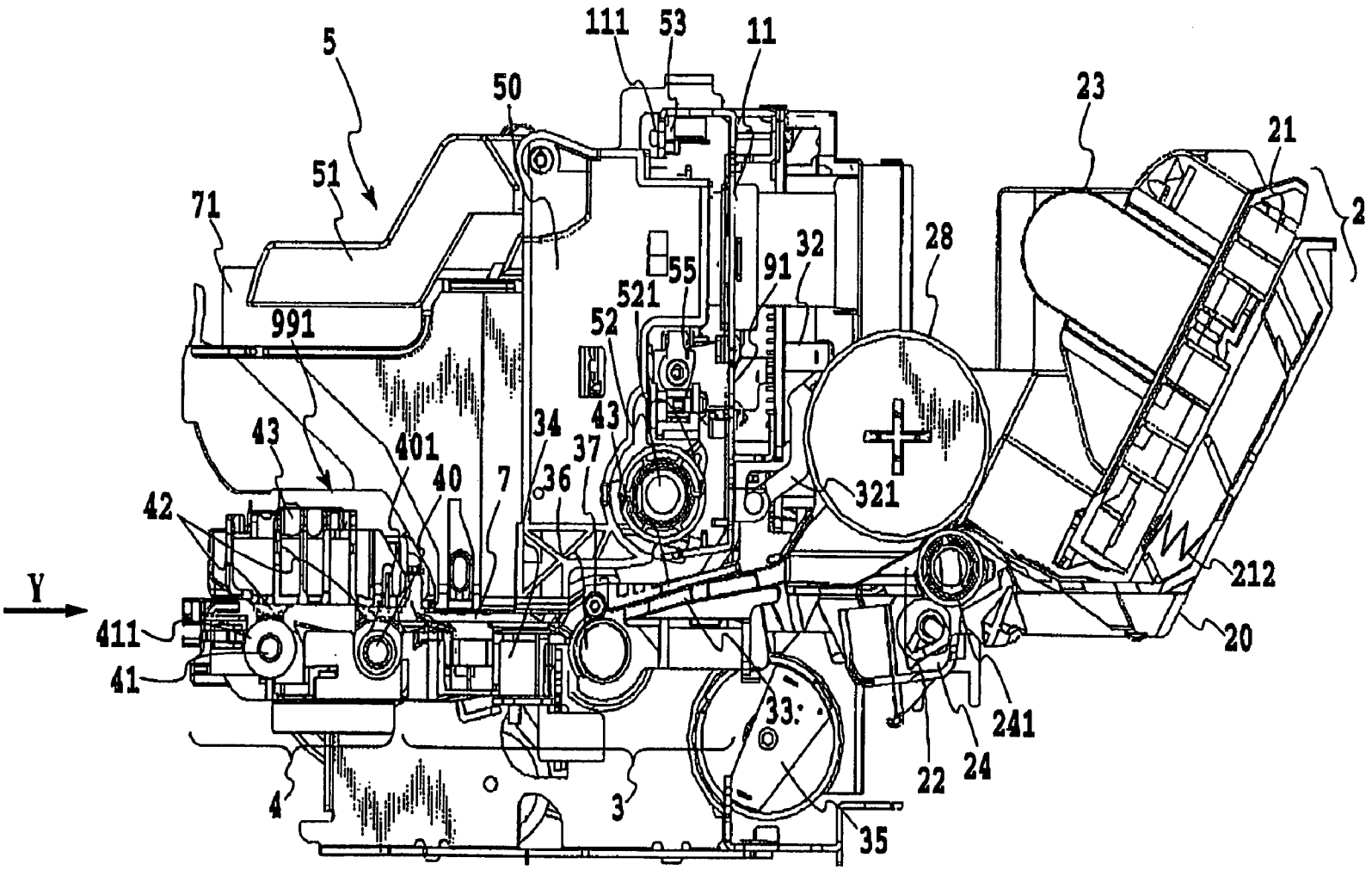
FIG. 5 is a cross-sectional view of the mechanical construction of the ink jet printing apparatus in the first embodiment.
Figure 6:
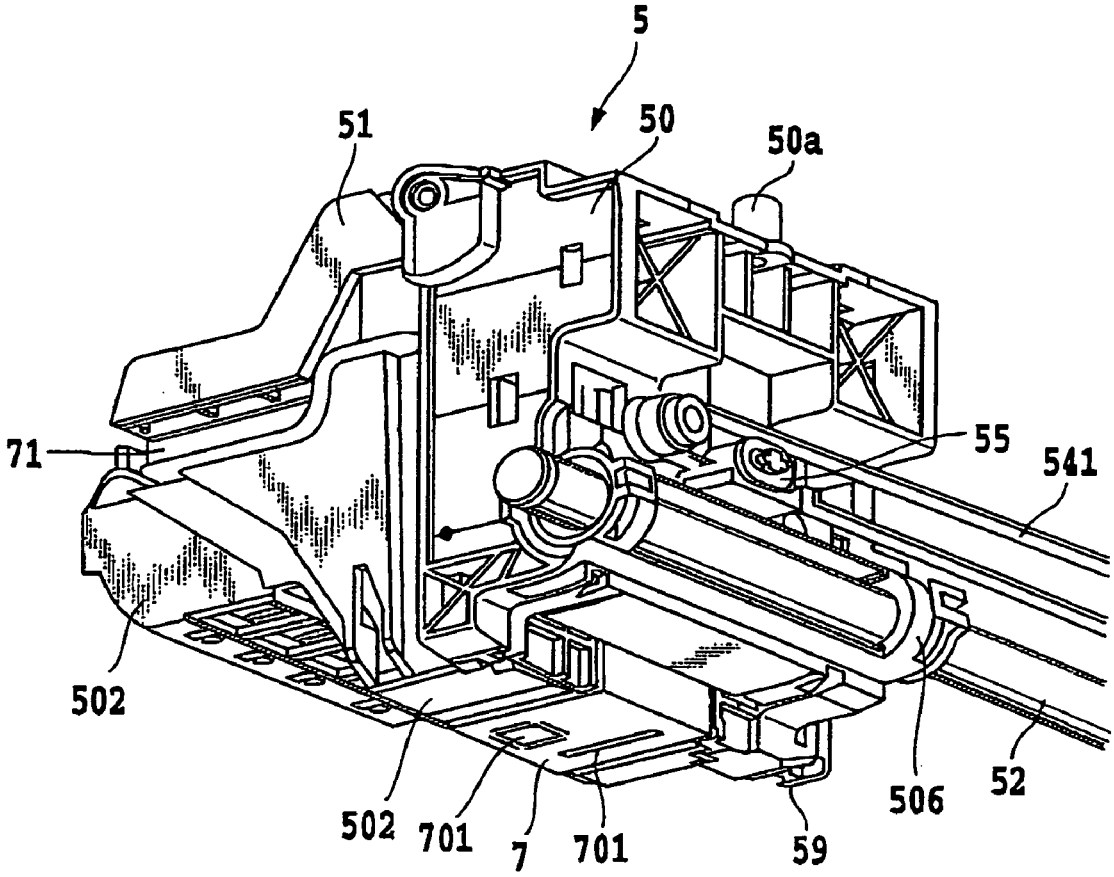
FIG. 6 is a perspective view of a carriage as a printing unit of the ink jet printing apparatus in the first embodiment.

A first embodiment of the present invention will be described by referring to FIG. 1 to FIG. 29. FIG. 1 and FIG. 2 are perspective views of an ink jet printing apparatus in the first embodiment. FIG. 3 and FIG. 4 are perspective views showing a mechanical construction of the ink jet printing apparatus in the first embodiment. FIG. 5 is a cross-sectional view of the mechanical construction of the ink jet printing apparatus. FIG. 6 is an explanatory view showing a carriage, a printing unit of the ink jet printing apparatus. FIG. 7 to FIG. 17 are views related to CD printing. FIG. 18 to FIG. 29 are explanatory views showing the carriage and a carriage lift mechanism of this embodiment, the carriage lift mechanism functioning as a gap changing means to change a gap between a print head mounted on the carriage and a print medium.

The printing apparatus 1 of this invention comprises a paper supply unit 2, a paper transport unit 3, a paper discharge unit 4, a carriage unit 5, a cleaning unit 6, a print head 7, a CD-R transport unit 8, and an electric circuit unit 9. Rough explanations on these will be given in the following.

(A) Paper Supply Unit

The paper supply unit 2, as shown in FIG. 5, has as main components a pressure plate 21 on which a large number of sheets of paper P are stacked, a feed roller 28 to feed the sheet P toward the print head, a separation roller 241 to separate the sheet P, and a return lever 22 to return the sheet to a paper stack position, all mounted on a base 20.

As shown in FIG. 2, a paper supply tray 26 for holding stacked sheets P is mounted on the base 20 or housing. The paper supply tray 26 is comprised of a plurality of plate members so that it is flexibly expandable. In use, the plate members are pulled out to increase a supported area of the sheets P.

The feed roller 28 is made of a bar-like material with a circular cross-section. This feed roller 28 has a separation roller rubber to feed a sheet of paper. The feed roller 28 is driven by a dedicated feed motor 273 (see FIG. 3) installed in the paper supply unit 2 through a drive force transmission gear and a planetary gear (not shown).

The pressure plate 21 is provided with a movable side guide 23 that can be moved to restrict a stacking position of the sheets P in a width direction (perpendicular to the feed direction). The pressure plate 21 is pivotable about a rotary shaft connected to the base 20 and is urged toward the feed roller 28 by a pressure plate spring 212. At a position on the pressure plate 21 that opposes the feed roller 28, a separation seat 213 made of a material with a large frictional coefficient, such as an artificial leather, is provided (not shown) to prevent a double feeding of sheets P near the bottom of the sheet stack. The pressure plate 21 is brought into or out of engagement with the feed roller 28 by a pressure plate cam (not shown).

Further, mounted on the base 20 is a separation roller holder 24, which holds the separation roller 241 for separating the sheets P one by one and is supported to be rotatable on a rotary shaft provided on the separation base 20. The separation roller holder 24 is urged toward the feed roller 28 at all times by a separation roller spring (not shown). The separation roller 241 is fitted with a clutch spring (not shown). When the separation roller 241 is applied with more than a predetermined load in the rotating direction, a portion supporting the separation roller 241 rotates, thus protecting the separation roller 241 and associated components from being loaded excessively. The separation roller 241 can be brought into or out of engagement with the feed roller 28 by a separation roller release shaft and a control cam (both not shown). Positions of these pressure plate 21, return lever 22 and separation roller 241 are detected by ASF sensors (not shown).

The return lever 22 for returning a sheet P to the paper stack position is rotatably mounted on the base 20 and urged by a return lever spring (not shown) toward a released position. When a sheet P is to be returned, the return lever 22 is rotated against the force of the return lever spring by the control cam to return the sheet P to the paper stack position.

How a sheet of paper is supplied using the above construction will be described.

In a normal standby state, the pressure plate 21 is urged by the pressure plate cam to part from (or disengage from) the feed roller 28 so that stacked sheets of paper are out of contact with the feed roller 28. The separation roller 241 is urged by the control cam to part from (or disengage from) the feed roller 28. The return lever 22 is rotated in such a direction as to return any advancing sheets P and is moved to a position such that it closes an opening to the stacked sheets to prevent the stacked sheets when loaded from moving forward into the transport path.

When in this standby state and paper feed is demanded, the motor is driven to cause the separation roller 241 to engage the feed roller 28. Then, the return lever 22 is released and the pressure plate 21 is moved toward the feed roller 28 until the sheets P stacked on the pressure plate 21 come into contact with the feed roller 28. In this state, the sheets P begin to be supplied. At this time, there is a possibility of two or more sheets P being fed simultaneously. These sheets P are restricted by a front stage separation unit 201 (not shown) provided on the base 20 so that only a predetermined number of sheets are fed to a nip portion between the feed roller 28 and the separation roller 241. The sheets P thus supplied are separated by the nip portion and only the top sheet is further fed.

When the sheet P reaches a transport roller 36 and a pinch roller 37 (described later), the pressure plate 21 and the feed roller 28 are returned to their release positions by the pressure plate cam 214 and the control cam, respectively. The return lever 22 is returned to the paper stack position by the control cam. At this time, the sheets P that were supplied to the nip portion formed by the feed roller 28 and the separation roller 241 are returned to the paper stack position.

(B) Paper Transport Unit

The sheet P, such as print paper, supplied from the paper supply unit is transported by the paper transport unit 3 shown in FIG. 3 and FIG. 4 along a transport path to the print head. The paper transport unit 3 is mounted to a chassis 11 formed of a metal sheet and has a transport roller 36 for feeding the sheet P. The transport roller 36 is constructed of a metal shaft with its surface coated with fine ceramic particles to provide high friction. The transport roller 36 is supported at its both ends on bearings 38 fixed in the chassis 11. Between the transport roller 36 and the bearings 38 is provided a transport roller tension spring 381 that gives a predetermined load to the transport roller during rotation to ensure a stable transport of paper.

Engaged with a circumferential surface of the transport roller 36 are a plurality of pinch rollers 37 that follow the rotation of the transport roller. The pinch rollers 37 are rotatably mounted on a pinch roller holder 30 that is pivotally supported by a rotating shaft on the chassis 11. The pinch roller holder 30 is urged by a pinch roller spring not shown so that the pinch rollers 37 are pressed against the circumferential surface of the transport roller 36. In this construction, the sheet P that was supplied from the paper supply unit 2 is held between the transport roller 36 and the pinch rollers 37 and transported by the rotating force of the transport roller 36. The pinch roller holder 30 is pivotally supported by the rotating shaft on bearings mounted in the chassis 11. At an inlet of the paper transport unit 3 to which the sheet P is supplied, a paper guide flapper 33 (see FIG. 5) for guiding the sheet P and a platen 34 are provided.

The pinch roller holder 30 is provided with a movable PE sensor lever 321 that is moved depending on the presence or absence of the sheet P. A position of the moved PE sensor lever 321 (see FIG. 5) is detected by a PE sensor to determine positions of front and rear ends of the print paper.

The platen 34 is mounted to the chassis 11 and the paper guide flapper 33 has one of its ends rotatably supported and fitted in the transport roller 36 and is positioned by engaging the chassis 11. Downstream of the transport roller 36 in the sheet transport direction (Y direction) is provided a print head 7 that forms an image according to image information.

In the above construction, as shown in FIG. 5, the sheet P that was fed from the paper supply unit 2 to the paper transport unit 3 is guided by the pinch roller holder 30 and the paper guide flapper 33 and forwarded to a roller pair of the transport roller 36 and the pinch roller 37. At this time, the PE sensor 32 detects a front end of the sheet P that was transported to the PE sensor lever 321, thus locating a print position of the sheet P. The sheet P is further fed over the platen 34 as the paired rollers 36, 37 are rotated by a transport motor 35. The platen 34 is formed with ribs that constitute a transport reference surface as shown in FIG. 3 and FIG. 4. A gap between the ribs and the print head 7 is controlled and a sheet waving phenomenon in which a sheet applied with ink easily elongates and forms waves is also controlled to prevent the sheet from excessively forming waves.

The transport roller 36 is driven by a rotating force of the transport motor 35 constructed of a DC motor which is transmitted through a timing belt 561 to a pulley 542 provided on the shaft of the transport roller 36. The shaft of the transport roller 36 is fitted with a code wheel 361 that is formed with markings at a predetermined pitch of 150–300 lpi. An encoder sensor 363 for reading the markings is mounted on the chassis 11 at a position adjacent the code wheel 361.

An ink tank 71 connected to the print head has a plurality of ink tanks of different ink colors that can be replaced individually. The print head 7 has electrothermal transducers (heaters) as ink ejection drive elements installed one in each nozzle. These electrothermal transducers are turned on or off to apply heat to ink in each nozzle to cause a film boiling in ink which in turn causes a bubble to grow or collapse, producing a pressure change and thereby ejecting an ink droplet from the nozzle.

(C) Carriage Unit

The carriage unit 5 has a carriage 50 mounting the print head 7. The carriage 50 has a slide portion **50*b* for a guide shaft 52 and, at the upper end portion thereof, a slide portion 50*a* for a guide rail 111 (see FIG. 6 and FIG. 7). The guide shaft 52 extends in a direction perpendicular to the transport direction of the sheet P (in a Y direction of FIG. 3 and FIG. 4). Along this guide shaft 52 the carriage 50 can be reciprocally moved for scanning. The guide rail 111 and the guide shaft 52 determine a gap between the print head 7 mounted on the carriage 50 and the sheet P. The guide shaft 52 and the guide rail 111 are secured to the chassis 11. A sliding portion of the guide rail 111 with the carriage 50 is lined with a thin sliding sheet 53** of stainless steel, for example, to reduce sliding noise.

The carriage 50 is driven by a carriage motor 54 mounted on the chassis 11 through a timing belt 541. The timing belt 541 is wound around and tensed by an idle pulley 542. The timing belt 541 is connected to the carriage 50 through a damper 55 made of rubber or the like which attenuates vibrations caused by the rotation of the carriage motor 54 to achieve a stable travel performance of the carriage 50.

A code strip 561 formed with markings at a predetermined pitch of 150–300 lpi to detect a position of the carriage 50 is provided parallel to the timing belt 541. Further, an encoder sensor (not shown) to read the code strip 561 is provided on a carriage base plate on which the carriage 50 is mounted. The carriage base plate (not shown) is also provided with contacts for electrical connection with the print head 7. The carriage 50 also has a flexible cable 57 through which to transmit a head signal from an electric board (here a main printed circuit board) 91 to the print head 7. With a carriage position where the carriage 50 contacts the chassis 11 taken as a reference position, the encoder sensor that reads the code strip 561 outputs a position signal whenever necessary for the detection of the position of the carriage 50 as shown in FIGS. 3 and 4.

The print head 7 is removably mounted on the carriage 50. That is, the carriage 50 has a tank cover 502 to securely hold the print head 7. The print head 7 is removably mounted in a space formed by the carriage 50 and the tank cover 502. The carriage 50 also has an abutment portion against which the print head 7 is pushed to position it at a predetermined portion of the carriage 50, and a pressing means (not shown) to press and fixedly hold the print head 7. The pressing means is mounted to a head set lever 51. With the head set lever 51 pivoted about a fulcrum and set, the pressing means acts to fix the print head 7 in the carriage 50.

A state of the print head 7 mounted on the carriage 50 as described above is shown in FIG. 6. The print head 7, when mounted on the carriage 50, has an ink ejection portion 701 oppose the transport unit and spaces near the ink ejection portion 701 are enclosed by the tank cover 502 so that in the event a print medium such as a sheet curls, the print medium can be prevented from being caught by the carriage 50.

Figure 7A:
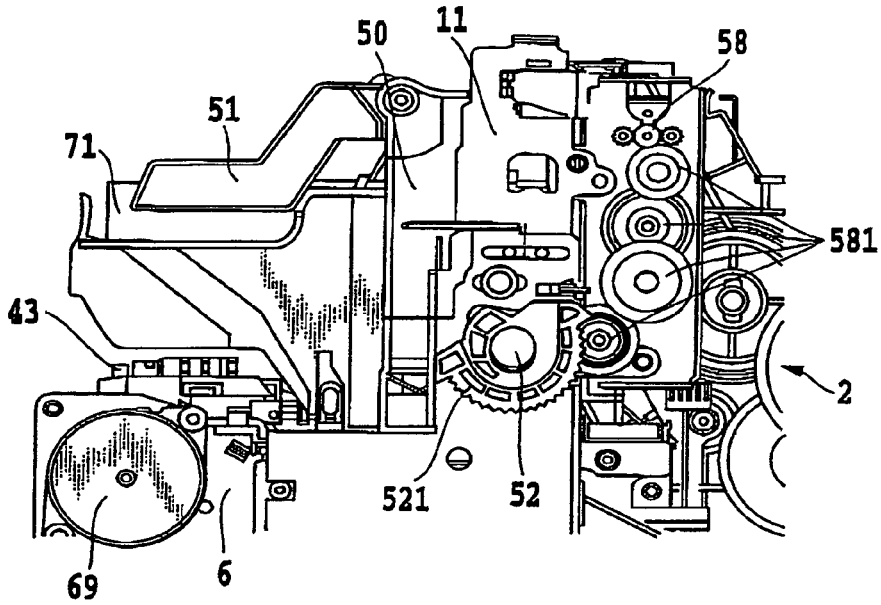
FIGS. 7A and 7B are side views of FIG. 6.
Figure 7B:
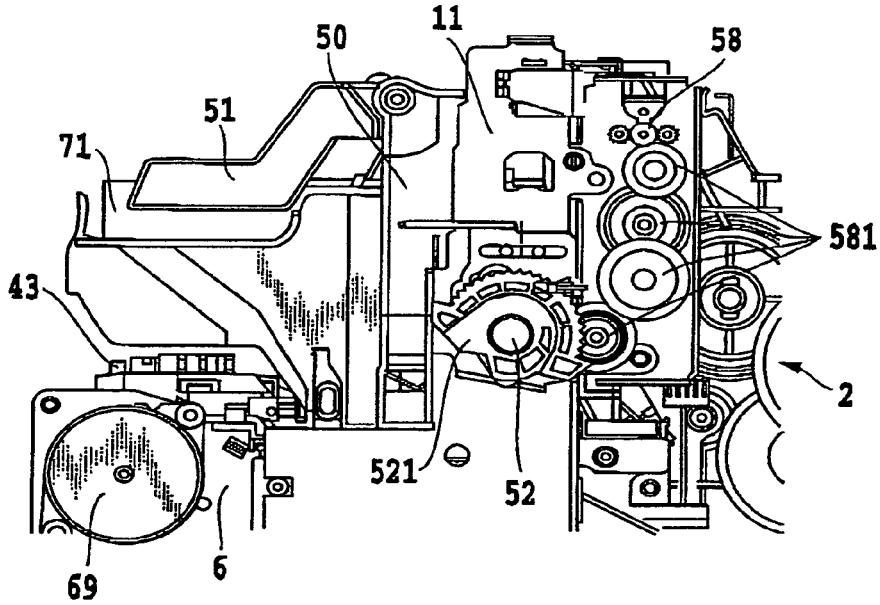
Figure 19A:
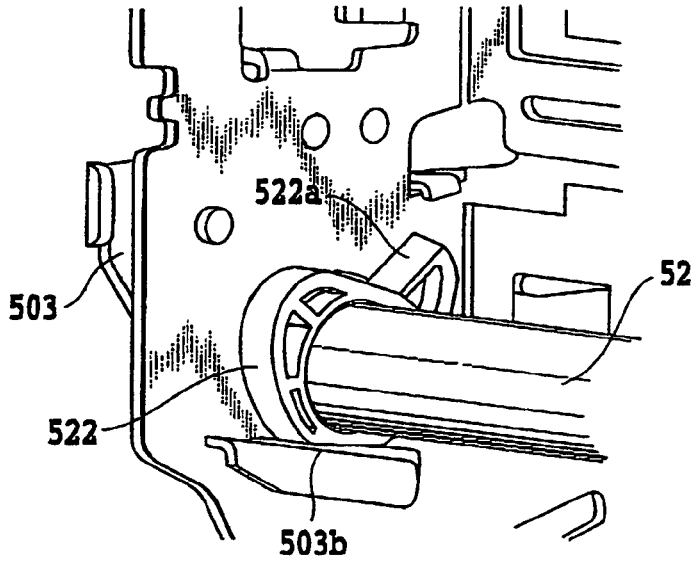
FIG. 19A is an explanatory perspective view showing a construction of an eccentric cam L of a carriage lift mechanism in the first embodiment.
Figure 19B:
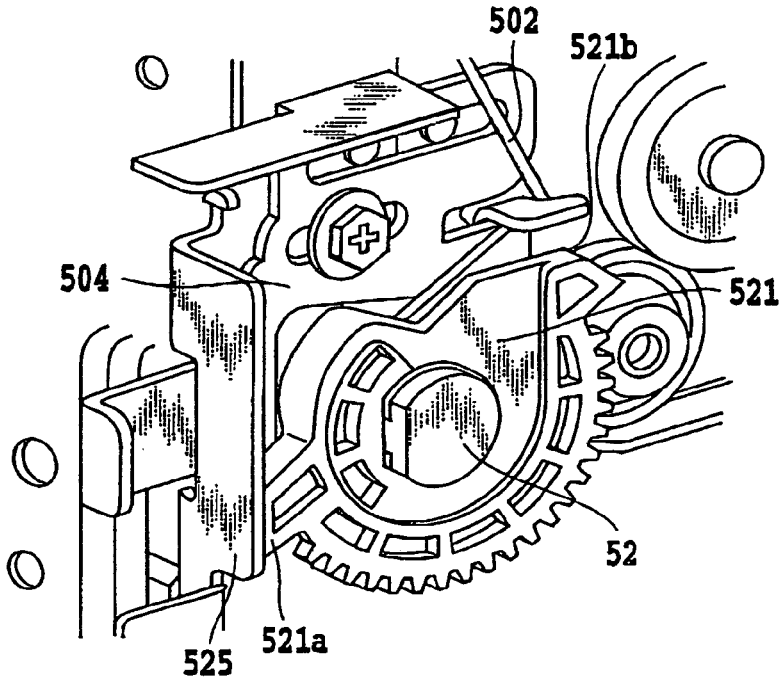
FIG. 19B is an explanatory perspective view showing a construction of an eccentric cam R of the carriage lift mechanism in the first embodiment.

Further, the guide shaft 52 (described later in more detail) is fitted at its ends with a left-side eccentric cam 521 and a right-side eccentric cam (not shown), as shown in FIGS. 7A, 7B and 19B. A drive force of a carriage lift motor 58 is transmitted to the left-side eccentric cam 521 through a gear train 581 to raise or lower the guide shaft 52. The vertical movement of the guide shaft 52 causes the carriage 50 to be lifted or lowered to keep an optimum gap for different thicknesses of sheets P.

The carriage 50 is also provided with a tray position detection sensor 59 which is constructed of a reflection type optical sensor to read a mark 82 for determining a position of a CD tray 83 (described later). This sensor 59 can detect the position of the tray 83 by emitting light from a light emitting element and receiving reflected light.

In the above construction, when an image is to be formed on a sheet P, the paired rollers 36, 37 intermittently feed the sheet P in the transport direction Y and at the same time the carriage 50 is moved by the carriage motor 54 in a direction X perpendicular to the sheet transport direction. During this process, the print head 7 receives a print signal from the main printed circuit board 91 and, according to the print signal, ejects ink droplets onto the sheet P to form an image.

(D) Paper Discharge Unit

The paper discharge unit 4 includes, as shown in FIG. 3 and FIG. 4, two discharge rollers 40, 41, spurs 42 kept in engagement with the discharge rollers 40, 41 under a predetermined pressure and idly rotated by them, and a gear train (not shown) to transmit a driving force of the transport roller to the discharge rollers 40, 41.

The discharge rollers 40, 41 are mounted to the platen 34. The discharge roller 40 located upstream of the sheet P in the transport direction (hereinafter simply described as "upstream") is constructed of a metal shaft with a plurality of rubber portions. The driving force of the transport roller 36 is conveyed through an idler gear to the discharge roller 40 which is then rotated. The discharge roller 41 is constructed of a resin shaft with a plurality of elastic portions of, for instance, elastomer. A driving force to the discharge roller 41 is transmitted from the discharge roller 40 through an idler gear.

The spurs 42 have a plurality of pointed portions along a circumference of a thin stainless steel plate of almost circular shape with a resin portion integrally secured to the circumferential surface of the stainless steel disc. The spurs 42 are pivotally mounted to a spur holder 43. The spurs 42 are held to the spur holder 43 by spur springs 44, each formed of a bar-like coil spring, which also press the spurs 42 against the discharge rollers 40, 41. The spurs 42 are provided at positions corresponding to the rubber portions and elastic portions of the discharge rollers 40, 41. The spurs 42 have two functions, one for generating a force for transporting the sheet P and one for keeping the sheet P from floating while being printed. Spurs 42 for the latter function are provided between portions where a sheet transport force is generated, i.e., at positions where there are no rubber portions 401 or elastic portions 411.

In front of the discharge rollers 40, 41 is provided a paper end support (not shown) which protects an image formed on an already discharged sheet P from being damaged by a newly discharged sheet P sliding on the printed surface of the already discharged sheet P. The paper end support is constructed of a resin member with rolls attached-at its front end. The resin member is urged by a paper support spring to press the rolls under a predetermined pressure against an unprinted surface of the sheet P being discharged. This causes the sheet P to be lifted at its lateral side portions so that it is stiffened and can be held above the already discharged sheet P.

With the above construction, the sheet P that was printed by the carriage unit 5 is held in a nip between the discharge rollers 40, 41 and the spurs 42 and discharged onto a discharge tray 46. The discharge tray 46 is constructed of a plurality (in this case, three) of divided plates and can be accommodated in a lower portion of a lower case 99 (described later). In use, the divided plates are drawn out. The discharge tray 46 rises in height toward its front end with its lateral end portions set higher than other portions to improve a discharged sheet stacking performance and prevent image degradations due to rubbing of the printed surface.

(E) Cleaning Unit

The cleaning unit 6, as shown in FIG. 3 and FIG. 4, includes a pump 60 for cleaning the print head 7, a cap 61 for preventing the drying of the print head 7, a blade 62 for cleaning a nozzle face of the print head 7, and a dedicated motor (cleaning motor 69; see FIG. 7A and 7B) for driving the pump 60.

This dedicated cleaning motor 69 (see FIGS. 8A and 8B) has a one-way clutch (not shown) so that a motor rotation in one direction activates the pump and in the opposite direction activates the blade 62 and the vertical movement of the cap 61.

The pump 60 produces a negative pressure by squeezing two tubes made of a flexible member (not shown) with a pump roller 68. The pump 60 is connected to the cap 61 through a valve. The cap 61 can be moved up or down to hermetically enclose the nozzle face of the print head 7 or release it. With the cap 61 in hermetic contact with the print head, the pump 60 is activated to suck out ink not suitable for printing from the print head 7. In the cap 61 is provided a cap absorbent 711 to reduce the amount of ink remaining on the face of the print head 7. In this embodiment, to prevent the residual ink in the cap absorbent 711 from becoming sticky and solid, the pump 60 is operated with the cap 61 open to draw out the ink remaining in the cap 61. The waste ink sucked out by the pump 60 is absorbed by and retained in a waste ink absorbent (not shown) provided in the lower case 99 (described later).

The above sequence of operations, including the vertical movement of the cap 61 and the operation of the blade 62, is controlled by a main cam 63 (not shown) that has a plurality of cams on a shaft. This control action is accomplished by an interaction between the cams of the main cam 63 and corresponding arms (not shown) in contact with these cams. The position of the main cam 63 can be detected by a position detection sensor 64 such as a photo interrupter. When the cap 61 is lowered (open), the blade 62 is moved perpendicularly to the scan direction of the carriage unit 5 to clean the face of the print head 7. The blade 62 has two types of blades, one for cleaning an area on the print head 7 on and around nozzles and one for cleaning the entire face. When the blade 62 moves back to a retracted position, it engages a blade cleaner 66 to remove ink from the blade 62 itself.

(F) Housing Unit

Figure 9:
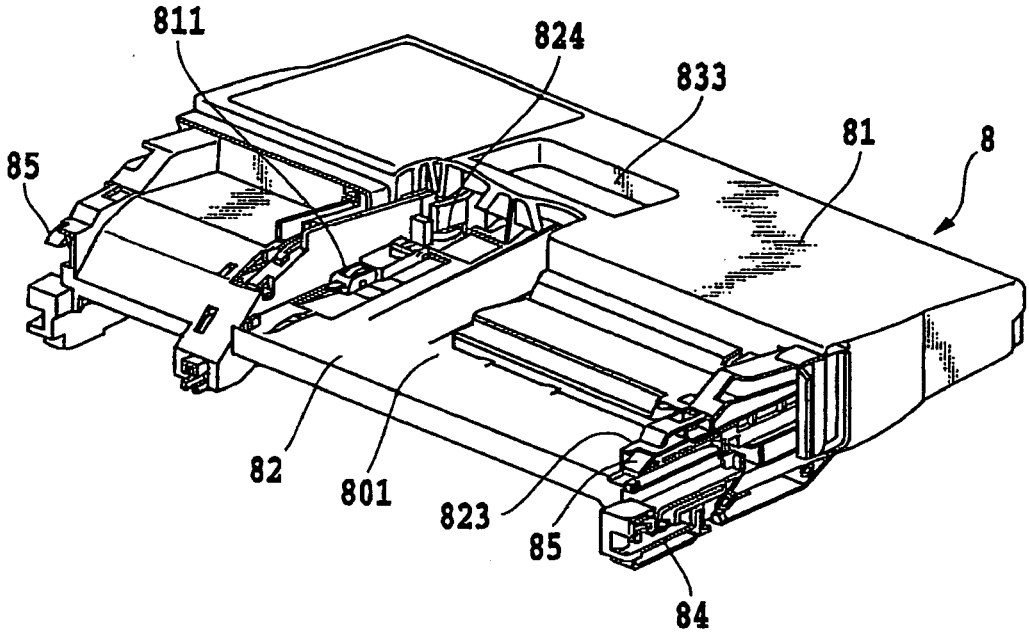
FIG. 9 is an explanatory perspective view showing an inner construction of the CD transport unit in the first embodiment.

The units described above are assembled into the chassis 11 to form a mechanical construction of the ink jet printing apparatus. Enclosing the mechanical construction is a housing unit 9, as shown in FIGS. 1, 2 and 9. The housing unit includes mainly a lower case 99, an upper case 98, an access cover 97, a connector cover (not shown), and a front cover 95.

In the lower part of the lower case 99 is accommodated, along with a discharge tray rail, the discharge tray 46 made up of a plurality of plate members formed collapsible in two or more tiers. The front cover 95 can close a paper discharge opening when the apparatus is not in use.

The upper case 98 is provided with an access cover 97 which is pivoted to be opened. As shown in FIG. 9, the upper case 98 has an opening in a part of a top surface thereof. By moving the carriage 50 to a position corresponding to this opening, the ink tank 71 and the print head 7 can be removed from or mounted to the carriage 50. The upper case 98 is also provided with a door switch lever for detecting the opening or closing of the access cover, an LED guide 982 for transmitting LED light for indication, and key switches 983*a*, 983*b* connected to switches on a printed circuit board. When the access cover 97 is pivoted, the door switch lever is operated to detect that the access cover 97 is open. Further, the upper case 98 is also fitted with the pivotable multi-stage paper supply tray 26. When the paper supply unit 2 is not in use, the paper supply tray 26 can be folded inwardly to function as a cover on the paper supply unit 2. FIG. 9 omits the access cover.

The upper case 98 and the lower case 99 are held together by elastic engagement claws. A connector (not shown) for making electrical connections with a personal computer is enclosed by a connector cover (not shown).

(G) CD Transport Unit

Figure 8A:
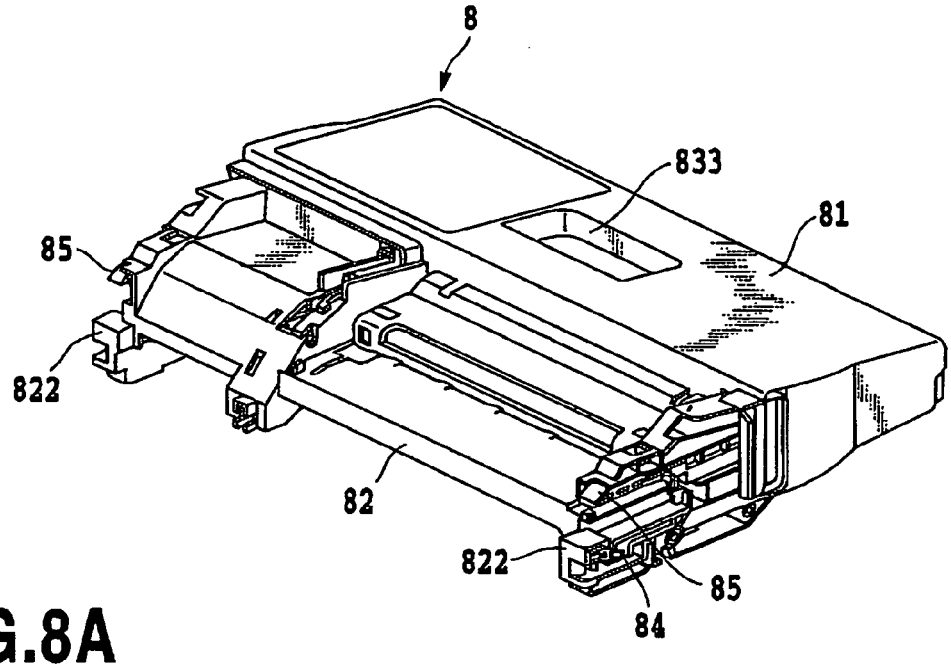
FIGS. 8A and 8B are perspective views of a CD transport unit in the first embodiment.
Figure 8B:
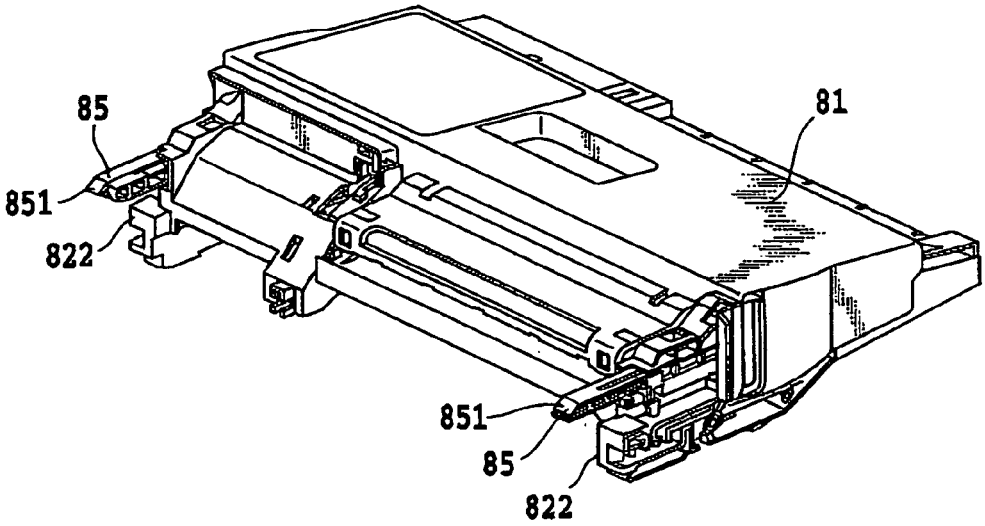
Figure 12A:
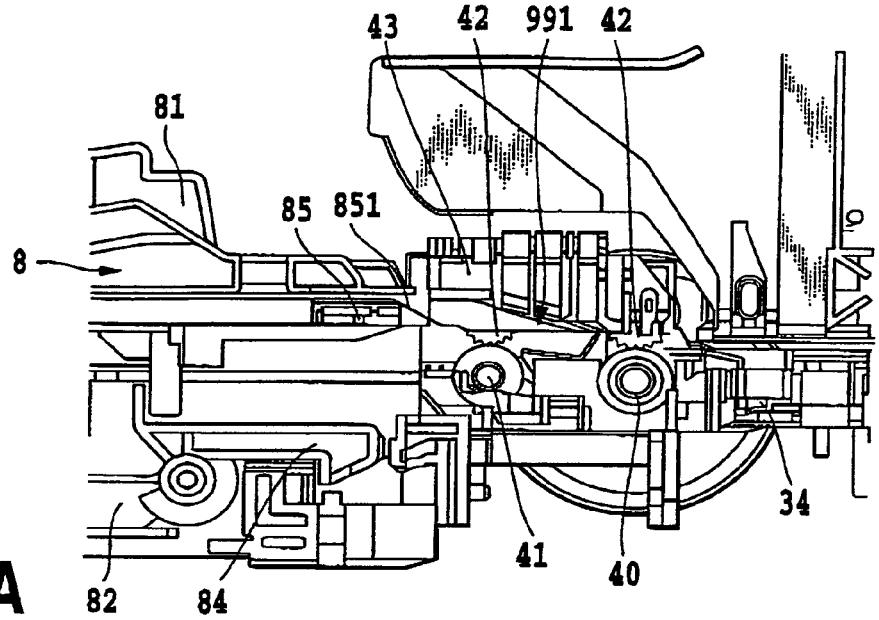
FIGS. 12A and 12B are explanatory side views showing the lower case and how the CD transport unit is mounted to the printing apparatus in the first embodiment.
Figure 12B:
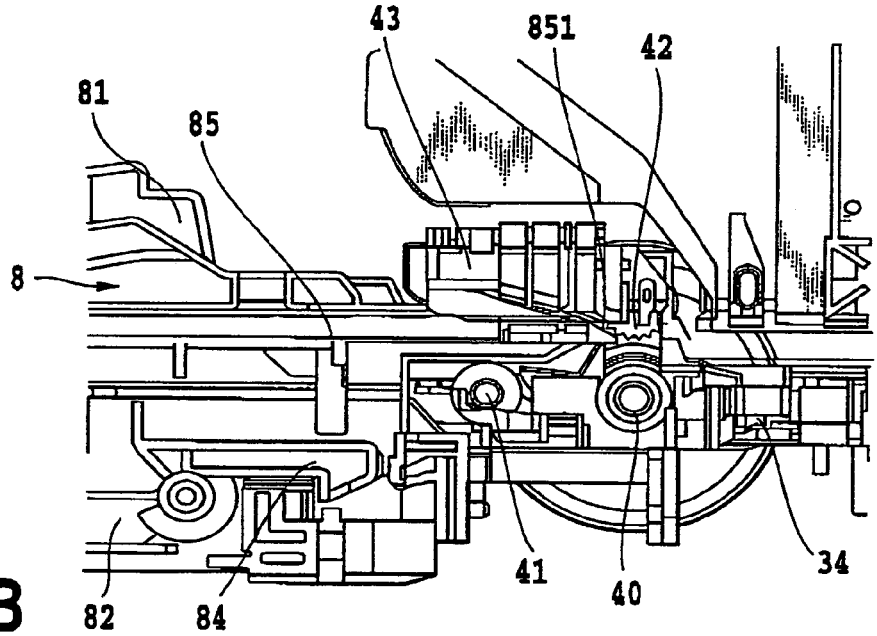
Figure 13:
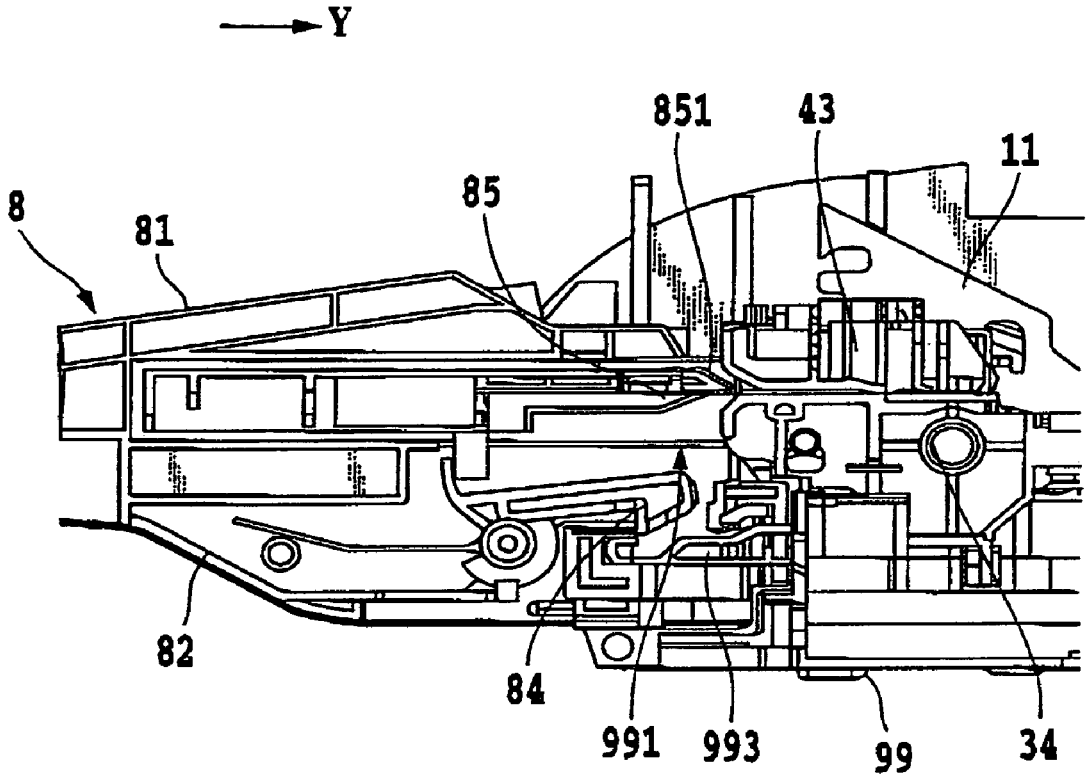
FIG. 13 is an explanatory side view showing the lower case and the CD transport unit in a hook-disengaged state in the first embodiment.
Figure 14:
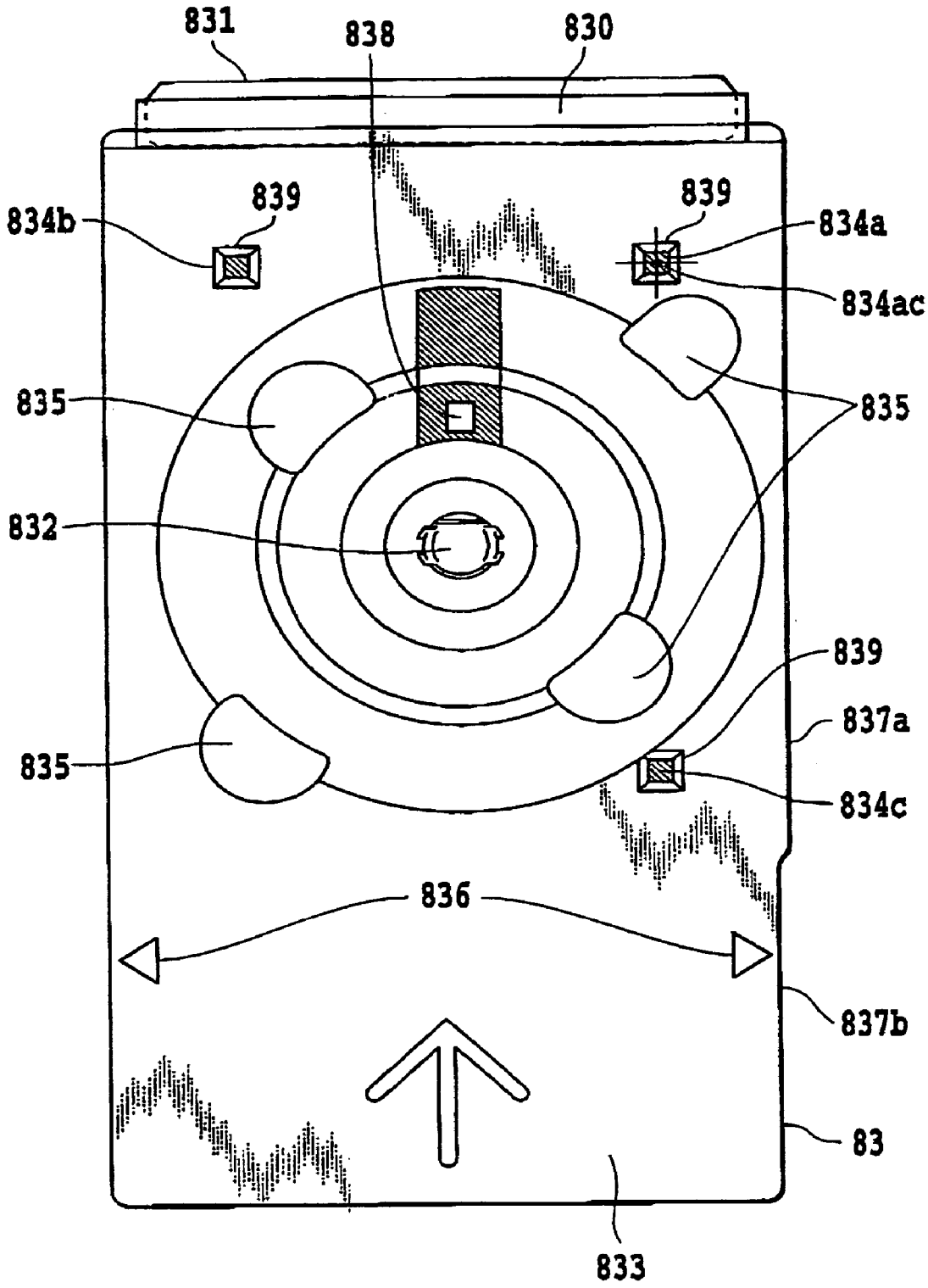
FIG. 14 is a plan view of a tray in the first embodiment of the invention.
Figure 15:
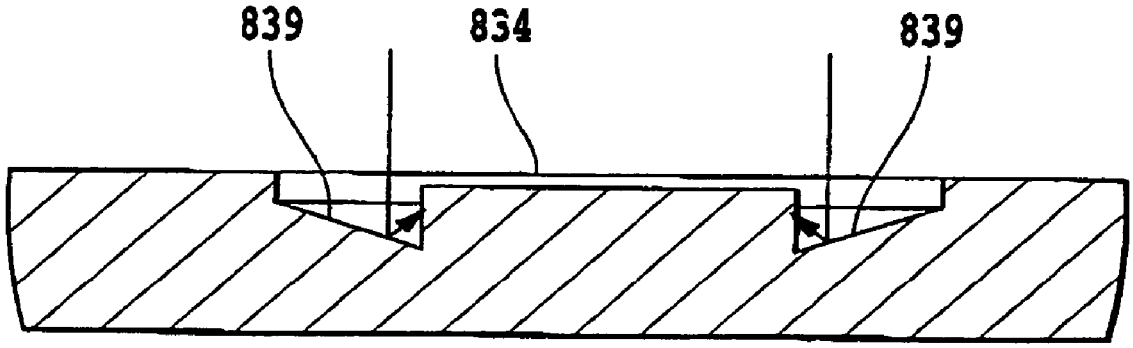
FIG. 15 is an explanatory cross-sectional view showing recesses formed in a periphery of a tray position detector in the first embodiment.
Figure 16:
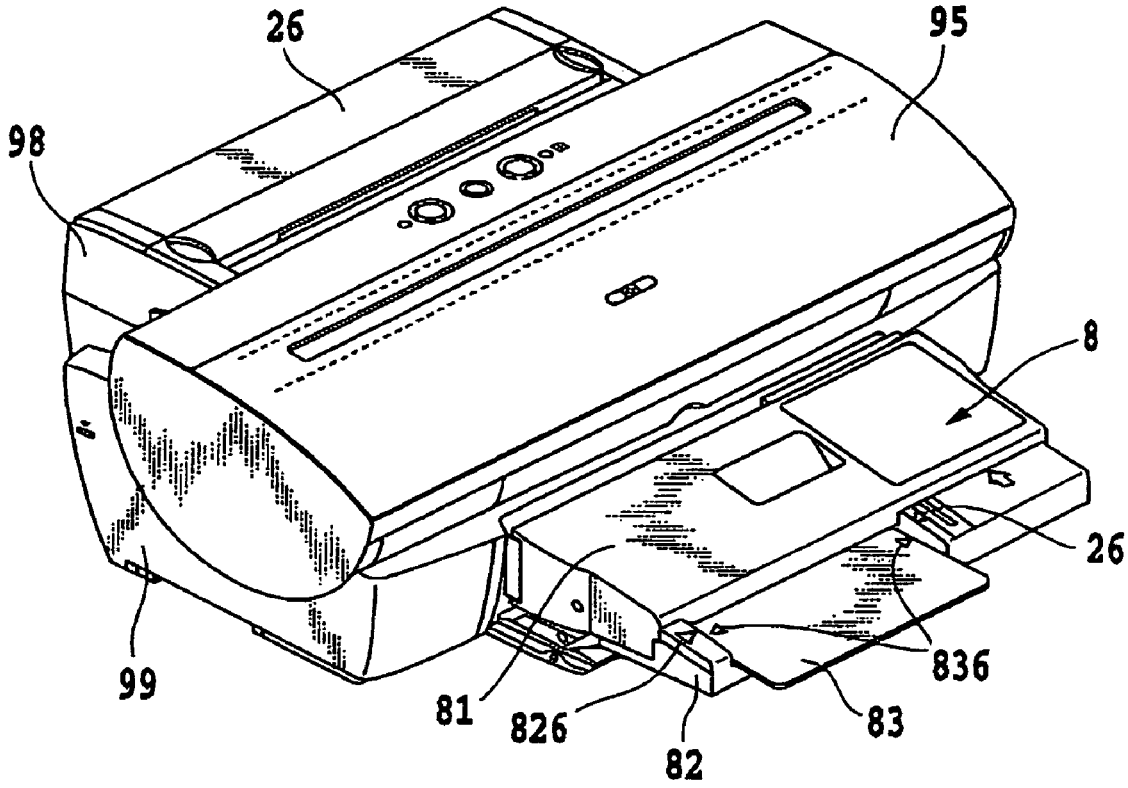
FIG. 16 is a perspective view showing the CD transport unit mounted on the printing apparatus and the tray loaded in the CD transport unit in the first embodiment.

A construction of the CD transport unit 8 and an operation of printing on a CD by using the CD transport unit will be explained by referring to FIGS. 8A to 17. FIGS. 8A and 8B are perspective views of the CD transport unit 8, FIG. 9 an explanatory perspective view showing an interior of the CD transport unit 8, FIGS. 10A and 10B explanatory perspective views showing how the CD transport unit 8 is mounted to the printing apparatus 1, and FIG. 11 a perspective view showing a construction of a mounting portion 991 provided in the lower case 99 and of a mounting detection portion. FIGS. 12A and 12B are explanatory side views of the CD transport unit 8 and the mounting portion 991 as the CD transport unit 8 is mounted to the printing apparatus 1, with FIG. 12A showing a state before an arm provided in the CD transport unit 8 is advanced and with FIG. 12B showing a state after the arm is advanced. FIG. 13 is an explanatory view showing a hook 84 of the CD transport unit 8 engaged with the lower case 99. FIG. 14 is a plan view of the tray 83 for mounting a print medium such as a CD for transport. FIG. 15 is an explanatory cross-sectional view showing recessed portions of a tray position detector of FIG. 14. FIG. 16 is a perspective view showing a state of the printing apparatus 1 in which the CD transport unit 8 is mounted to the apparatus with a slide cover 81 slid back and the tray 83 set. FIGS. 17A to 17F are explanatory plan views showing a positional relation between the tray position detection sensor 59 provided on the carriage 50 and the tray 83.

In these figures, the CD mounting tray 83 (see FIG. 14) is supported in the CD transport unit 8. As shown in FIGS. 12A, 12B and FIG. 13, the CD transport unit 8 includes a tray guide (tray support means) 82, a slide cover 81 that forms an opening for inserting the tray 83 into the tray guide 82, a hook 84 provided in the lower case 99 to hold the CD transport unit 8 to the lower case 99, and a pair of left and right arms 85 which, when the CD transport unit 8 is mounted to the printing apparatus 1, causes the spur holder 43 (described later) to slide upward in the apparatus.

A tray insertion portion 801 (see FIG. 9) in the CD transport unit 8 is formed with a reference wall 823 as a reference for the insertion position of the tray 83. On a wall surface opposing the reference wall 823 is provided a side pressure roller 824 that is urged by a roll spring (not shown) to protrude from the wall surface. The side pressure roller 824 presses the tray 83 loaded into the tray insertion portion 801 against the reference wall 823 to position it in the lateral, horizontal direction (perpendicular to the tray insertion direction). The side pressure roller 824 presses against an external side surface 837*a* (see FIG. 14) of the tray 83 until the tray 83 is inserted to a predetermined set position. When the tray 83 is inserted to a position where it can be transported by the transport roller 36 and the pinch rollers 37 (see FIG. 3 to FIG. 5) installed in the printing apparatus 1, an escape portion 837*b* (see FIG. 14) that is recessed inwardly from the external side surface 837*a* faces the side pressure roller 824. As a result, the side pressure roller 824 no longer presses against the tray 83, releasing the sideward pressing force. Thus, during the tray transport operation, the side pressure roller 824 does not apply an unwanted back tension to the tray 83, preventing a possible degradation of tray transport accuracy.

In a tray insertion portion 801 of the slide cover 81 in the CD transport unit 8 a pair of left and right press rollers 811 are rotatably supported so that they are vertically movable. The press rollers 811 are urged upward by roll springs (not shown). The tray 83 inserted into the tray insertion portion 801 is supported elastically by the force of the roll springs. When the CD transport unit 8 is mounted to the mounting portion 991 in the printing apparatus 1, the tray 83 supported in the CD transport unit 8 is pressed against the discharge rollers 40, 41 in the printing apparatus 1 and receives a transport force from the discharge rollers 40, 41. This transport force causes the tray 83 to be transported from the set position to a nip portion between the transport roller 36 and the pinch rollers 37. Then, the tray 83 transported to the rollers 36, 37 is intermittently fed according to the movement of the carriage unit 5 in the main scan direction, thus forming an image on a CD held on the tray 83.

Figure 10A:
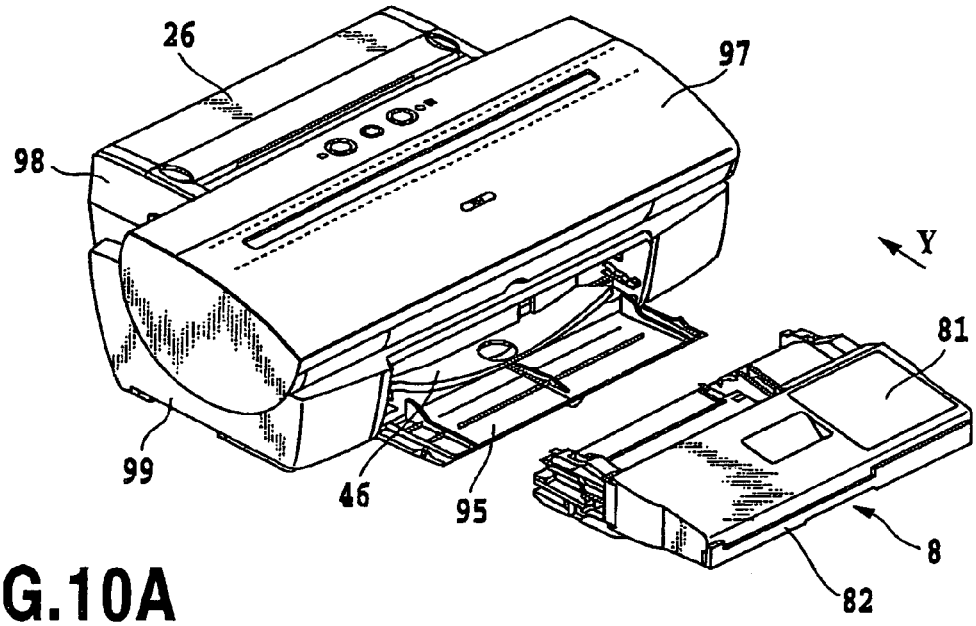
FIGS. 10A and 10B are perspective views showing how the CD transport unit is mounted to the printing apparatus in the first embodiment.
Figure 10B:
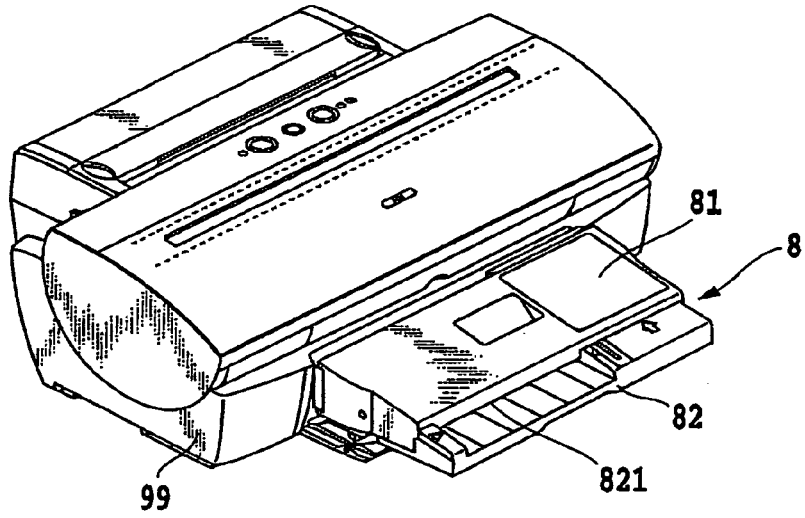
Figure 11:
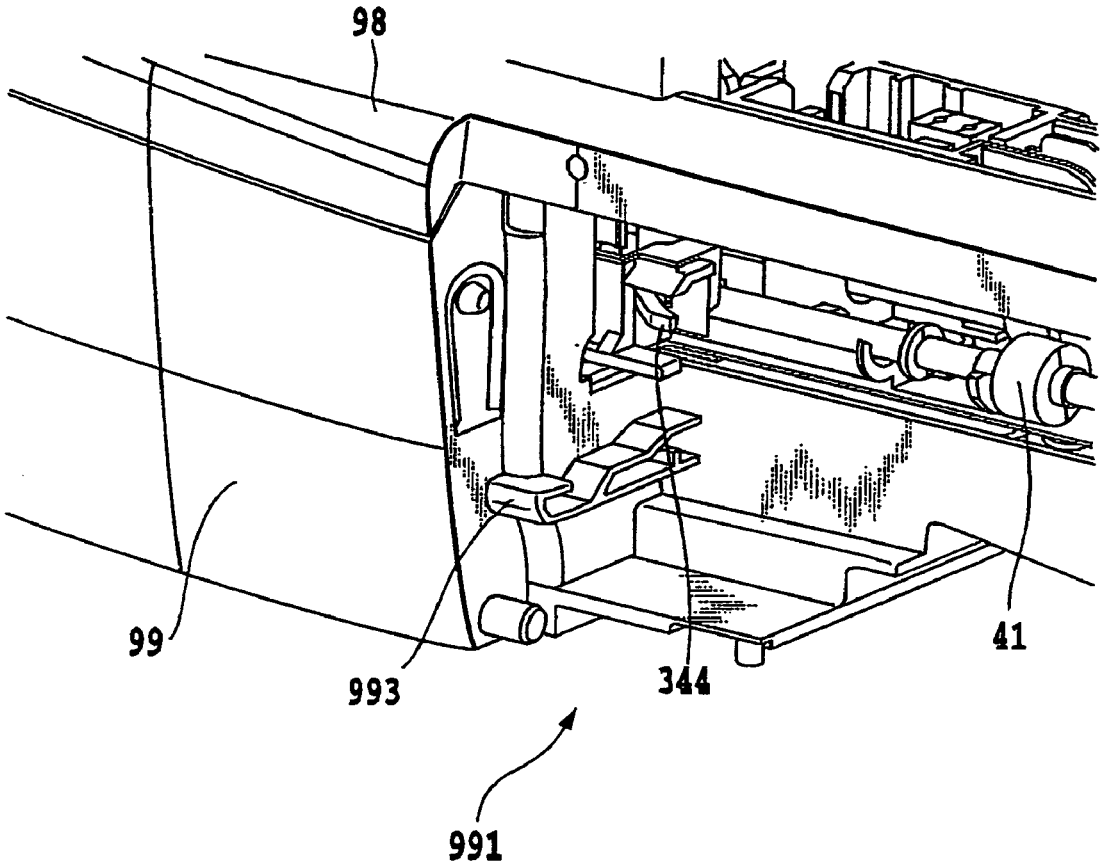
FIG. 11 is an explanatory perspective view showing a construction of a CD transport unit mounting portion and a mounting portion detector, both provided in a lower case in the first embodiment.

FIGS. 10A and 10B show the CD transport unit 8 as it is mounted to the printing apparatus 1. As shown in FIGS. 10A and 10B, in the process of mounting, the CD transport unit 8 is first held toward the mounting portion 991 of the printing apparatus 1. Then, the CD transport unit 8 is moved straight in the direction of arrow Y and inserted into the opening of the mounting portion 991 formed in the lower case 99. At this time, engagement portions 822 at both sides of the tray guide 82 are inserted along guide rails 993 provided at both sides of the lower case 99 shown in FIG. 11. This allows the CD transport unit 8 to be positioned easily in the vertical and horizontal directions, assuring a smooth insertion of the unit. On both sides of the tray guide 82 there are pivotable hooks 84 (see FIGS. 12A and 12B) that are urged in a predetermined rotary direction. After the CD transport unit 8 is inserted to a predetermined position, it can no longer be advanced. At this point, the hooks 84 are activated by stoppers of the guide rails 993 to lock the inserted CD transport unit 8 from moving back. The platen 34 in the printing apparatus 1 is provided with a tray guide sensor (detection means) 344 of mechanical structure to detect when the tray guide 82 is mounted. When the tray guide 82 is inserted to an appropriate position in the mounting portion 991 of the printing apparatus 1, a part of the tray guide 82 presses the tray guide sensor 344 which then outputs a predetermined detection signal. Based on this detection signal, a decision is made as to whether the mounting condition is good or not.

In the mounting process described above, when the slide cover 81 is moved toward the printing apparatus 1, arms 85 interlocked with the slide cover 81 are projected toward the printing apparatus 1, as shown in FIG. 8B. Meanwhile, the spur holder 43 rotatably supporting the spurs 42 is supported vertically slidable on the platen 34 and urged downward by a predetermined force of a spring. Thus, as the arms 85 are inserted between the spur holder 43 and the platen 34, the spur holder 43 is pushed up a predetermined distance against the force of the spring.

This process is shown in FIG. 12A and FIG. 12B. FIG. 12A illustrates a state before the arms 85 are projected and FIG. 12B illustrates a state in which the arms 85 are projected to slide the spur holder 43 up. At this time, slope portions 851 formed at front ends of the arms 85 facilitate a smooth insertion of the arms 85 between the platen 34 and the spur holder 43. With the arms 85 inserted between the platen 34 and the spur holder 43, a space is formed between the platen 34 and the spur holder 43, large enough for the tray 83 to pass through. The arms 85, when inserted between the platen 34 and the spur holder 43, are held immovable at a predetermined position, whereas, when they are retracted in the tray guide 82, the arms 85 have a play with the tray guide 82.

In a state where the slide cover 81 is not moved toward the printing apparatus 1, the opening 821 shown in FIG. 12B is closed, so the tray 83 cannot be inserted. If in this state the slide cover 81 is pushed toward the printing apparatus 1, the slide cover 81 slides upward at an angle, exposing the opening 821 between it and the tray guide 82. Then, the tray 83 loaded with a CD can be inserted from the opening 821 and set at a predetermined position. At this time, the spur holder 43 is raised by the arms of the slide cover 81, thus eliminating the possibility that an interference between the inserted tray 83 and the spurs 42 may damage a tray seat 831 at the front end of the tray 83 or spurs 42.

Next, the process of dismounting the CD transport unit 8 from the printing apparatus 1 will be described.

As shown in FIG. 13, when the slide cover 81 of the tray guide 82 is pulled away from the printing apparatus 1, i.e., in a direction opposite the Y direction of FIGS. 10A and 10B, the arms 85 interlocked with the slide cover 81 are retracted from the spur holder 43, allowing the spur holder 43 and the spurs 42 to move down to their initial positions. At this time, if the tray 83 is left inserted in the printing apparatus 1, the tray 83 gets stuck in the opening 821 formed between the slide cover 81 and the tray guide 82, making it impossible to pull the slide cover 81 any further. This protects a CD remaining in the printing apparatus 1 from being damaged by the spurs 42 moving down. With the tray 83 taken out of the CD transport unit 8, withdrawing the slide cover 81 toward the initial retracted position causes the slide cover 81 to act on the hooks 84 in the process and release them from the guide rails 993 of the lower case 99, thus allowing the CD transport unit 8 to be dismounted from the apparatus.

Next, a construction of the tray 83 will be explained. The tray 83, as shown in FIG. 14, is formed of a resin plate about 2–3 mm thick and has a CD mounting portion 832, a grip portion 833 to be held by the user when loading or unloading the tray, position detection marks 834 (834*a*, 834*b*, 834*c*), CD pickup holes 835, insertion position alignment marks 836, a side pressure roller escape portion 837*b*, and a media presence/absence detection mark 838. Further, at the front end of the tray 83 a tray seat 831 is projected from the tray 83 in the transport direction to ensure a firm grip on the tray 83 by the transport roller 36 and the pinch rollers 37.

The tray seat 831 is bonded by a double-sided adhesive tape to a planar portion 83*a*, opposite the CD mounting surface, of a tapered portion 830 formed at the front end of the tray 83. The tray seat 831 is formed of a film thinner than the front end of the tray 83. For example, the tray seat 831 uses a PET about 0.1–0.3 mm thick as a base material, with one of its surfaces coated with a coating material to give it a desired frictional coefficient and hardness. In this embodiment in particular, the coating material is not a commonly used material, such as rubber and urethane, that easily adheres to a mating member but one having a predetermined surface roughness and a higher hardness than those of rubber and urethane. If rubber or urethane is used, when the tray seat 831 engages a member such as the paper guide flapper 33 of resin installed in the transport path of the tray 83, the coating material comes into intimate contact with the member, significantly increasing a transport load. To deal with this problem, a coating material with a predetermined surface roughness and a high level of hardness is chosen.

The coated surface is provided on that surface of the tray seat 831 which contacts the transport roller 36. This ensures that when the coated surface is in contact with the transport roller 36, a sufficient transport force to feed the tray 83 can be produced. The tray seat 831 is formed in an almost trapezoidal shape, as shown in FIG. 14, and is secured to the front end portion of the tray 83 so that its shorter side protrudes outwardly from the tray 83. In this embodiment, a distance A by which the tray seat 831 projects from the tray 83 in the transport direction is about 3 mm. The protruding distance A is such that, when the front end portion of the tray seat 831 reaches the nip portion between the transport roller 36 and the pinch rollers 37, the front end portion of the tray 83 does not touch the nip portion. That is, when the front end portion of the tray seat 831 is gripped by the nip portion, the gripping action of the nip portion is not interfered with by the front end portion of the tray 83.

The tray 83 itself has a tapered portion 830 at the front end. First, the tray seat 831 is gripped between the transport roller 36 and the pinch rollers 37 and this produces a tray transport force. The pinch rollers 37 are lifted along the tapered portion 830 attached at the front end of the tray 83 so that the relatively thick tray 83 can be held between the transport roller 36 and the pinch rollers 37 for transport.

The position detection marks 834 provided on the tray 83 comprise two position detection marks 834*a*, 834*b* formed on the front side of the CD mounting portion of the tray 83 and one position detection mark 834*c* on the opposite side. The position detection marks 834 in this embodiment are each formed of a highly reflective, square member 5 mm on each side. Here, a hot stamping is used to form the marks. Around each of these position detection marks 834 is formed a recessed portion 839 which can clearly define a range of reflected light from the resin position detection marks 834. That is, a bottom surface of each recessed portion 839 has a high planarity and is inclined at a predetermined angle with respect to the surface of the position detection marks 834, as shown in FIG. 15. Thus, if the light emitted from the tray position detection sensor 59 provided on the carriage 50 should be reflected outside the position detection marks 834, it can be prevented from returning to the sensor, thus eliminating erroneous detections.

As described above, since a light reflectivity of the position detection marks 834 on the tray 83 is high, there is no need to mount a high-performance sensor and correction processing can also be reduced, minimizing cost and printing time. Further, compared with a technique that directly reads an edge of a print area of a CD, this embodiment can perform a precise position detection even when printing on a colored CD or re-printing on a printed CD.

When a CD is to be mounted on the tray 83, a center hole of the CD is aligned with the CD mounting portion 832 as it is put on the tray. When the CD is to be removed, the user puts his or her fingers into the two CD pickup holes 835 to hold an outer circumferential edge of the CD. The CD mounting portion 832 is provided with a plurality of molded claws that act to position the CD as it is mounted and to also eliminate play. Further, the CD mounting portion 832 has a recessed surface lower than other areas of the tray 83 which is provided with a media presence/absence detection mark 838. The recessed surface is provided to form a hot stamp of a predetermined width with a hole of a predetermined width therein. It is decided that no media is present when the hole of a predetermined width is detected.

The position detection marks 834 are located between the pinch rollers 37 so that their surfaces will not be scored by the pinch rollers 37.

The tray 83 that was transported to a predetermined position can be taken out of the tray guide 82 by withdrawing it. Further, the user can hold the outer circumferential edge of the CD by inserting his fingers into two CD pickup holes 835 and remove it from the tray.

(Printing Operation)

Next, the process of printing a print area on the surface of a CD by using the ink jet printing apparatus of the above construction will be described.

First, the CD transport unit 8 is slid straight toward the printing apparatus and mounted to the lower case 99. At this time, when the tray guide 82 is mounted to the printing apparatus 1, the tray guide sensor 344 detects it.

Then, moving the slide cover 81 toward the printing apparatus 1 causes the arms 85 interlocked with the slide cover 81 to project toward the apparatus. As the arms 85 advance between the spur holder 43 and the platen 34, they lift the spur holder 43 a predetermined distance.

As described above, when the slide cover 81 is moved toward the printing apparatus 1, the slide cover 81 slides upward at an angle to expose the opening 821 between it and the tray guide 82. Then a CD is placed on the CD mounting portion 832 of the tray 83. The user holds the grip portion 833 and inserts the CD-mounted tray 83 into the opening 821 until the position detection marks 834 align with a tray set mark 826 on the tray guide 82. The tray 83 thus set is shown in FIG. 16.

In this state, when a print signal is sent from a host, the apparatus starts printing. First, the transport roller 36 and the discharge rollers 40, 41 rotate in a reverse direction. Since the tray 83 is pressed under a predetermined pressure against the discharge rollers 40, 41 by the press rollers 811 through roll springs 812 (not shown), the tray 83 is transported by the rotating force of the discharge rollers in the reverse direction, i.e., into the apparatus. Then, the tray seat 831 is gripped by the transport roller 36 and the pinch rollers 37 and reliably moved by a predetermined transport force. The pinch rollers 37 then ride on the tapered portion 830 at the front end of the tray 83 so that the tray 83 is held between the transport roller 36 and the pinch rollers 37.

Next, the carriage 50 is moved from the home position to the print area to detect the tray 83. The lifting operation of the carriage 50 and the guide shaft 52 will be explained later. As shown in FIG. 7B, the carriage lift motor 58 is driven to raise the guide shaft 52 to form an optimum gap for the tray 83.

Figure 17A:
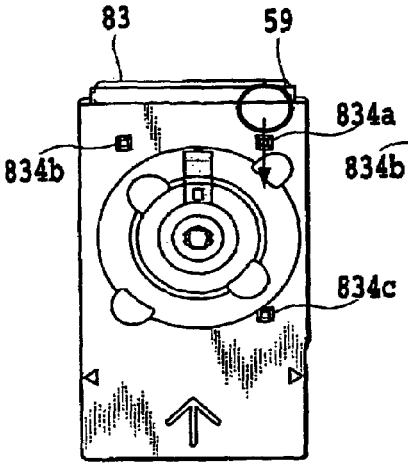
FIGS. 17A to 17F are explanatory plan views showing a positional relation between the tray and a position detection sensor in the first embodiment.
Figure 17B:
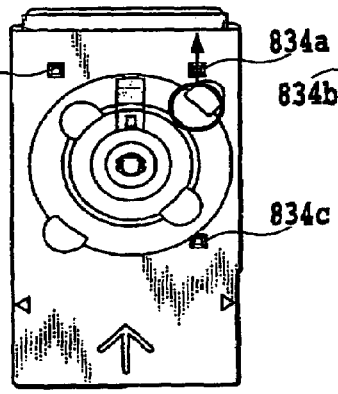
Figure 17C:
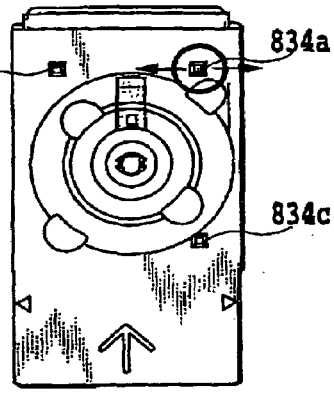

Next, as shown in FIGS. 17A and 17B, the carriage 50 is stopped at a position where its tray position detection sensor 59 aligns with the position detection mark 834*a* on the tray 83. Then, the tray 83 is transported and an edge on the upper side of the position detection mark 834*a* is detected (see FIG. 17A). The tray 83 is further transported until an edge on the lower side of the position detection mark 834*a* is detected (see FIG. 17B). Next, the tray 83 is moved back until the tray position detection sensor 59 comes at almost the center of the position detection mark 834*a*, and the carriage 50 is moved left and right to detect a right edge position and a left edge position of the position detection mark 834*a* (see FIG. 17C). Now, a center position 834*ac* of the position detection mark 834*a* can be calculated and, based on the center position 834*ac*, the print position of the CD placed on the tray 83 can be determined.

As described above, since this embodiment detects the position of the tray itself, print position variations resulting from parts precision variations and tray conditions can be reduced when compared with a technique that performs printing by depending solely on a mechanical precision and not performing a position detection.

Figure 17D:
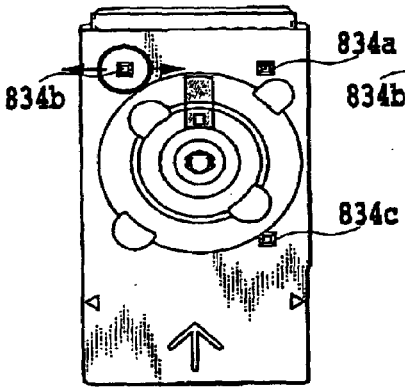
Figure 17E:
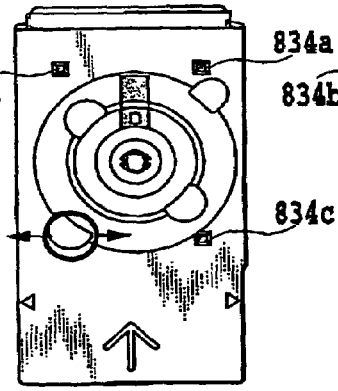

After detecting the position of the position detection mark 834*a*, the carriage 50 is moved to the position detection mark 834*b* to detect its position as shown in FIG. 17D. Detecting edges at both ends of the position detection mark 834*b* can confirm that the position of the position detection mark 834*a* detected earlier is correct. That is, if the tray 83 is set farther inwardly than the correct set position and the position detection mark 834*c* is detected, as shown in FIG. 17E, the process of moving the carriage 50 for finding the position detection mark 834*b* can determine that the position detection mark 834*c* found is not the position detection mark 834*a*.

If it is decided that the position detection mark found is not the position detection mark 834*a* but the position detection mark 834*c*, the tray 83 is transported to a position where the tray position detection sensor 59 faces the position detection mark 834*a* and then the search-and-detect operation for the position detection mark 834*a* is executed. At this time, if the position detection mark 834*a* is not found, this is interpreted as an error and the tray 83 is discharged.

Figure 17F:
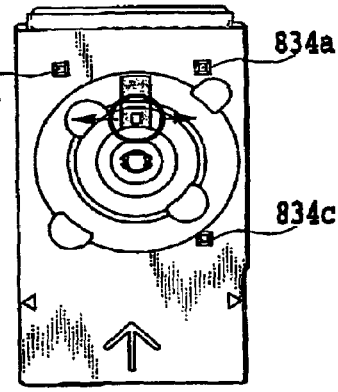

After the position of the tray 83 has been detected, as shown in FIG. 17F, it is transported in the tray transport direction until the tray position detection sensor 59 of the carriage 50 aligns with the media presence/absence detection mark 838 on the tray 83. At this time, if the edge of the detection hole in the media presence/absence detection mark 838 is detected and the hole width matches a predetermined width, it is decided that a CD is not mounted, interrupting the printing operation, discharging the tray 83 to a predetermined position and indicating an error. If the media presence/absence detection mark 838 is not found, it is decided that a CD is loaded and the printing operation proceeds.

With the above-mentioned series of initial operations completed, the tray 83 loaded with the CD that is set in the printing apparatus 1 is transported to a predetermined position for printing. Then, according to print data sent from the host, the printing operation is executed. In the printing operation, a multipass printing that forms an image with a plurality of scans is performed to minimize the occurrence of banding that results depending on a transport accuracy and dot landing precision of the head 7.

After the printing operation is finished, the tray 83 is transported back to the initial position, i.e., the position where the user placed the tray 83 on the tray guide 82 before the printing operation. In this state, the user can take out the CD-loaded tray 83 that has undergone the printing operation. Further, pulling the slide cover 81 forward can release the arms 85 from the spur holder 43, disengaging the hooks 84 from the lower case 99. Now, the CD transport unit 8 is unlocked from the printing apparatus 1 and can be dismounted.

(Carriage Lift Mechanism)

Figure 18A:
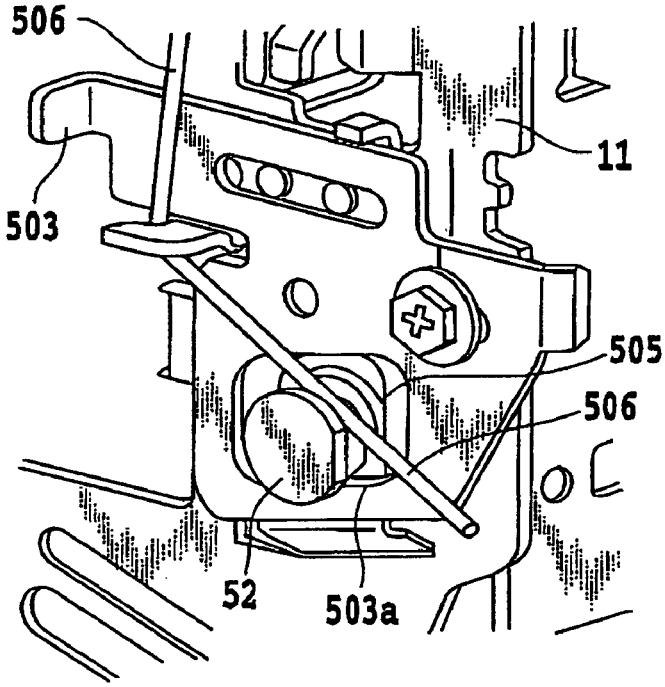
FIGS. 18A and 18B are explanatory perspective views showing a support mechanism for a carriage shaft in the first embodiment.
Figure 18B:
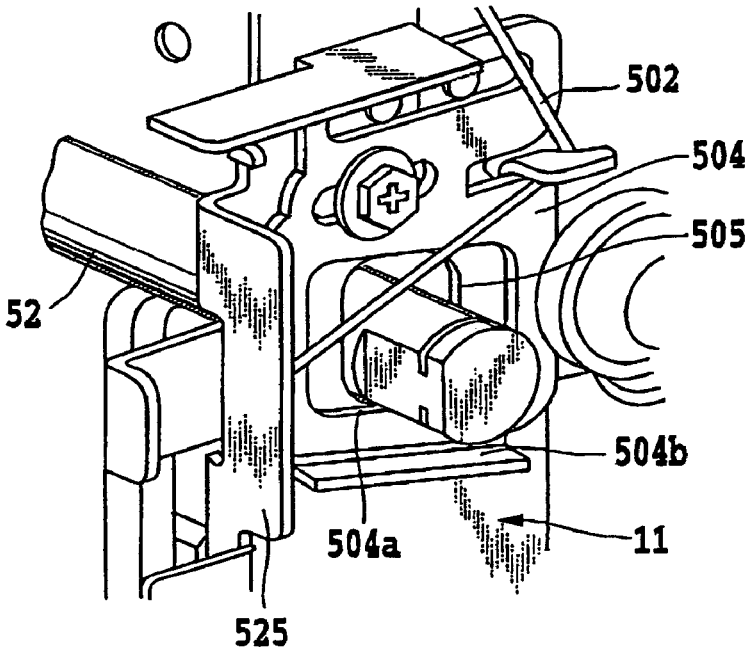
Figure 20:
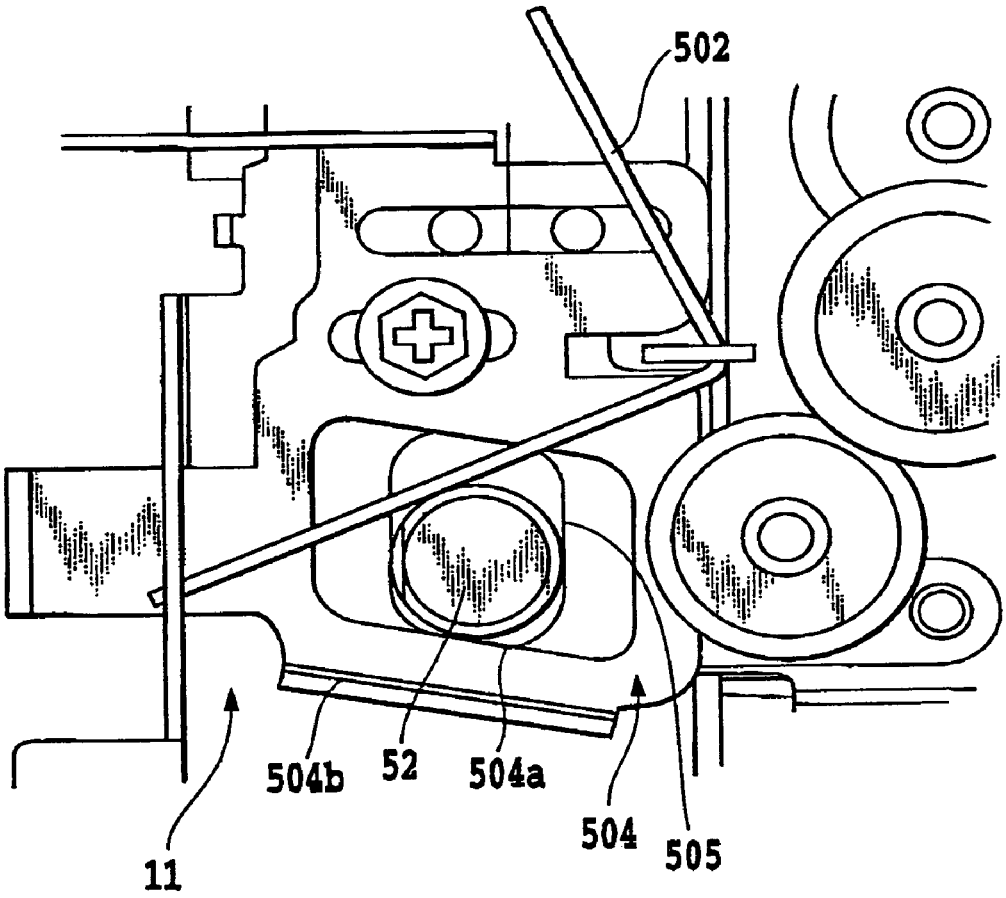
FIG. 20 is an explanatory side view showing the carriage lift mechanism in the first embodiment.

Next, a mechanism for lifting the carriage 50 (gap changing mechanism) will be described with reference to FIG. 18A to FIG. 32. FIG. 18A and FIG. 19A are perspective views showing a left-side portion of a guide shaft lift mechanism to raise or lower a guide shaft 52. FIG. 18B and FIG. 19B are perspective views showing a right-side portion of the guide shaft lift mechanism. FIG. 20 is a side view showing a part of the gap adjust mechanism for adjusting a gap between the carriage or the print head mounted on the carriage and a print medium such as paper. FIG. 21 to FIG. 24 illustrate a supported state of the carriage for a print medium of normal thickness. FIG. 25 to FIG. 28 illustrate a supported state of the carriage when thick paper is used as a print medium. FIG. 29 to FIG. 32 illustrate a supported state of the carriage when a CD or the like is used as a print medium.

First, the mechanism for lifting the carriage 50 and the guide shaft 52 will be explained by referring to FIG. 18A to FIG. 20. In FIGS. 18A–20, the carriage 50 and the guide shaft 52 are shown supported in a state suited for the printing of a normal print medium about 0.3 mm or less thick (normal printing).

The guide shaft 52 of the carriage 50 is positioned by a gap adjust plate L (also called a paper gap adjust plate L) 503 and a gap adjust plate R (also called a paper adjust plate R) 504. The guide shaft 52 is positioned in the paper transport direction by engaging it with a vertical surface 505 of the chassis 11 shown in FIG. 20 through a force of a guide shaft spring 506. Thus, if the height of the guide shaft 52 changes, its position in the paper transport direction remains unchanged, so that the guide shaft 52 is kept at a constant position at all times by the vertical surface 505 of the chassis 11.

A guide shaft support portion 503*a* of the gap adjust plate L 503 and a guide shaft support portion 504*a* of the gap adjust plate R 504 are formed as inclined surfaces. By sliding the gap adjust plates L 503 and R 504 forward and backward along their inclined surfaces, a fine adjustment can be made of the height of the guide shaft 52 during the normal printing. Further, the gap adjust plate L 503 and the gap adjust plate R 504 are integrally formed with eccentric cam abutment faces 503*b*, 504*b* extending parallel to the guide shaft support portions 503*a*, 504*a*.

At the left end of the guide shaft 52, as shown in FIG. 19A, an eccentric cam L 522 is provided on the inner side of a left side surface 11*b* of the chassis 11. At the right end of the guide shaft 52 an eccentric cam R 521 is provided as shown in FIG. 19B. The eccentric cam L 522 and the eccentric cam R 521 are fixedly secured to the guide shaft 52 so that they rotate together. The eccentric cam R 521 has a cam surface and a gear portion. As shown in FIG. 7A and 7B, a drive (rotating) force of the carriage lift motor 58 is transmitted through a gear train 581 to the gear portion of the eccentric cam R 521. Thus, by controlling the rotary position of the eccentric cam R 521 by the carriage lift motor 58, the height position of the guide shaft 52, i.e., the gap position, can be adjusted.

At the left end of the guide shaft 52 on the inner side of the chassis 11 is provided the eccentric cam L 522, which has a rotation restriction portion L 522*a* that engages the carriage 50 to restrict the rotation of the eccentric cam L 522.

During the normal printing shown in FIG. 18A to FIG. 20, the guide shaft 52 is not positioned by the cam surfaces of the eccentric cams R 521, L 522, but by the gap adjust plate L 503 and the gap adjust plate R 504.

Next, by referring to FIG. 21A to FIG. 32, the process of adjusting the gap of the carriage 50 by driving the carriage lift mechanism will be described.

Figure 21A:
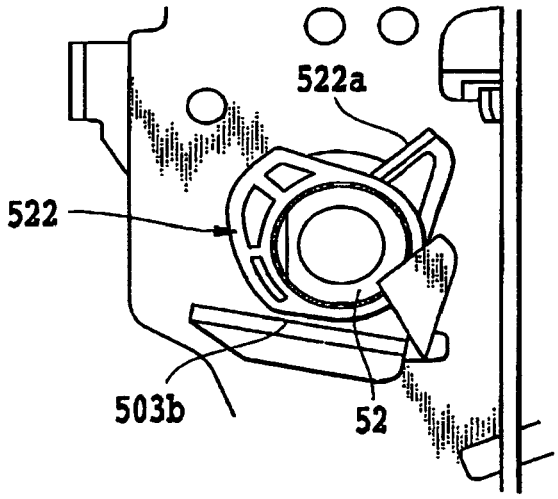
FIGS. 21A and 21B are explanatory side views showing the carriage lift mechanism in a normal printing state in the first embodiment.
Figure 21B:
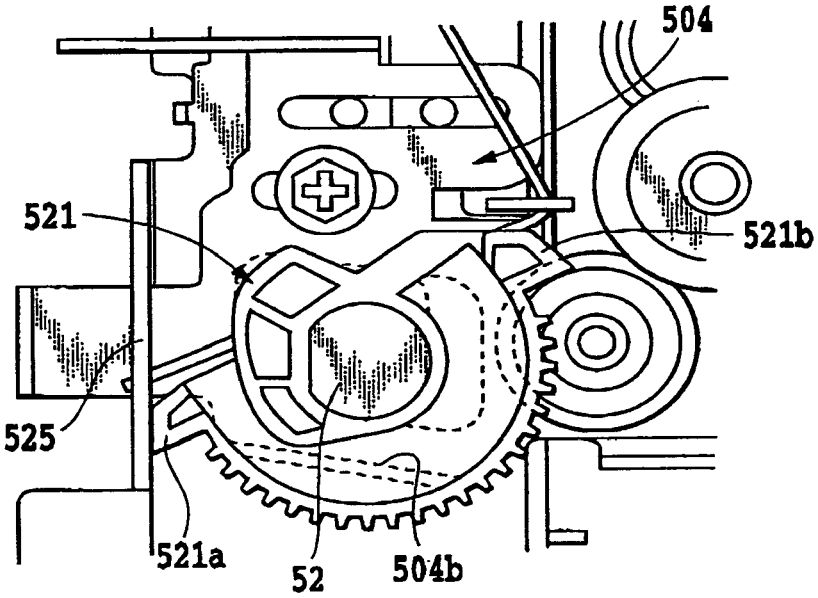
Figure 22:
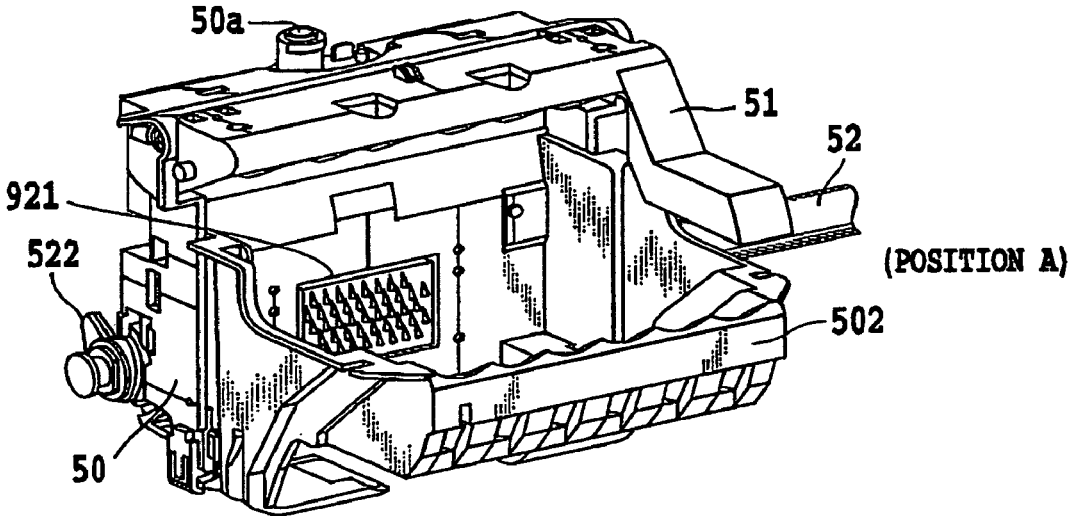
FIG. 22 is an explanatory perspective view showing the carriage lift mechanism in the normal printing state in the first embodiment.
Figure 23:
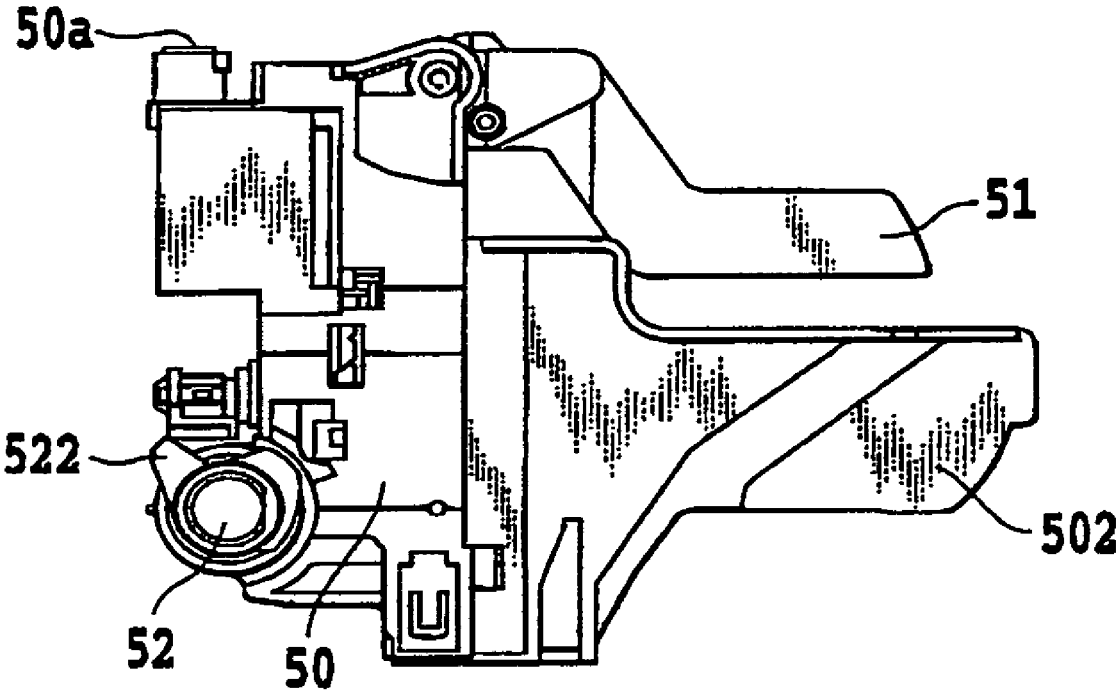
FIG. 23 is a side view of FIG. 22.
Figure 24:
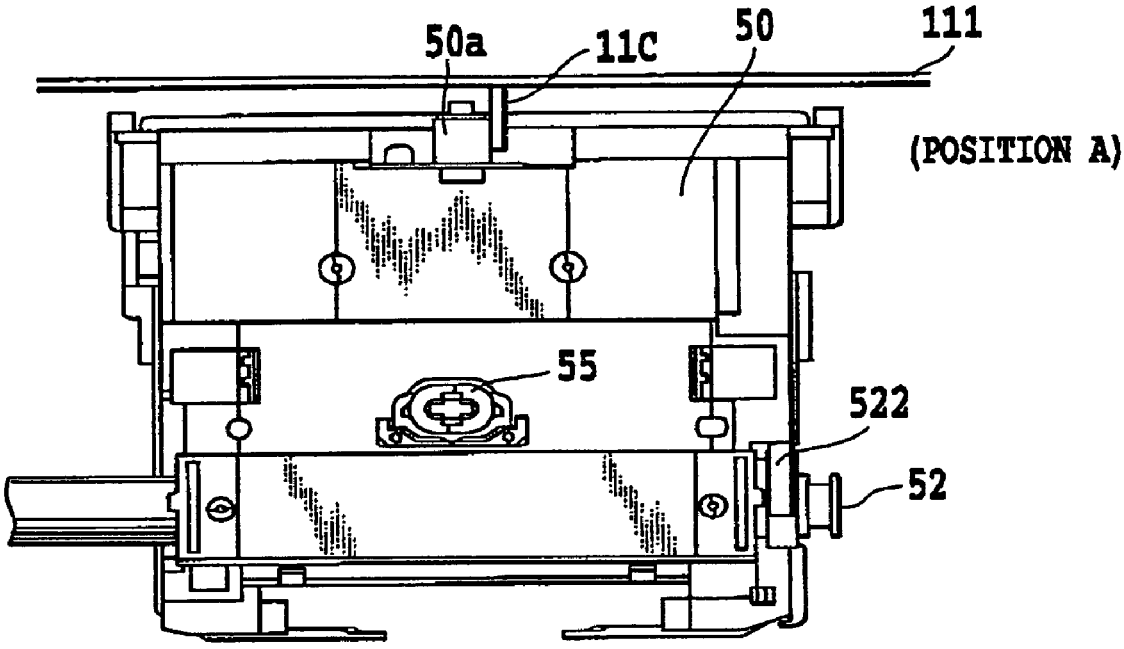
FIG. 24 is a rear view of FIG. 22.
Figure 25A:
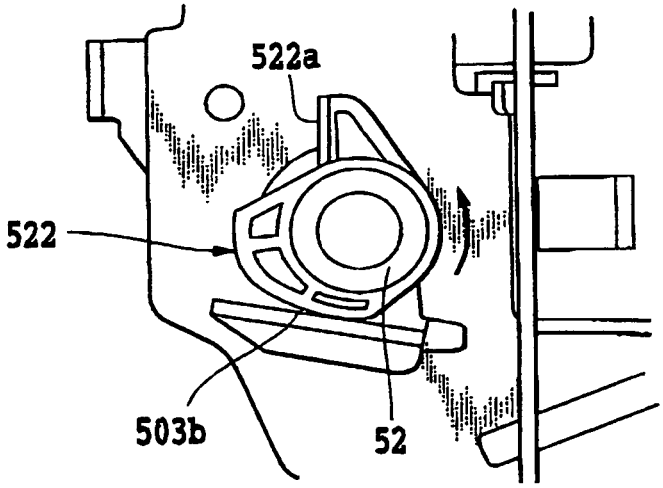
FIGS. 25A and 25B are explanatory side views showing the carriage lift mechanism in a thick paper printing state in the first embodiment of the invention.
Figure 25B:
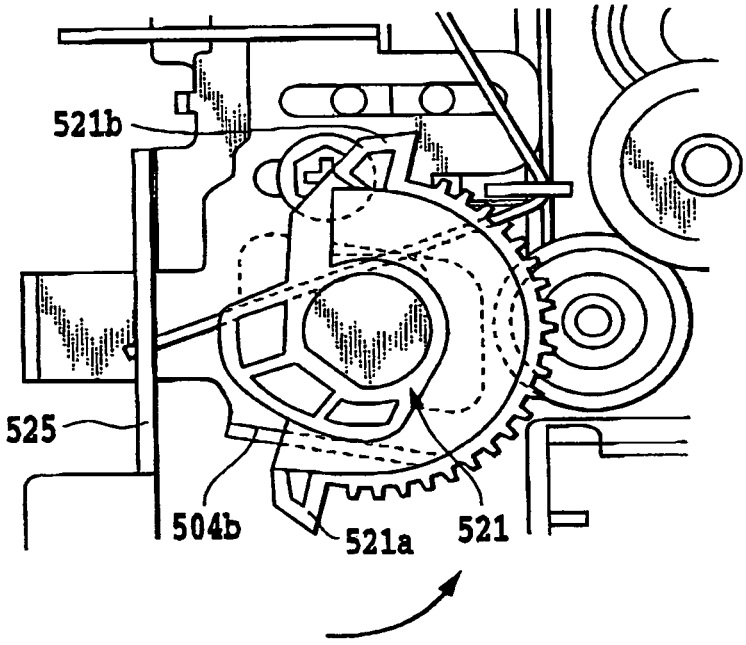
Figure 26:
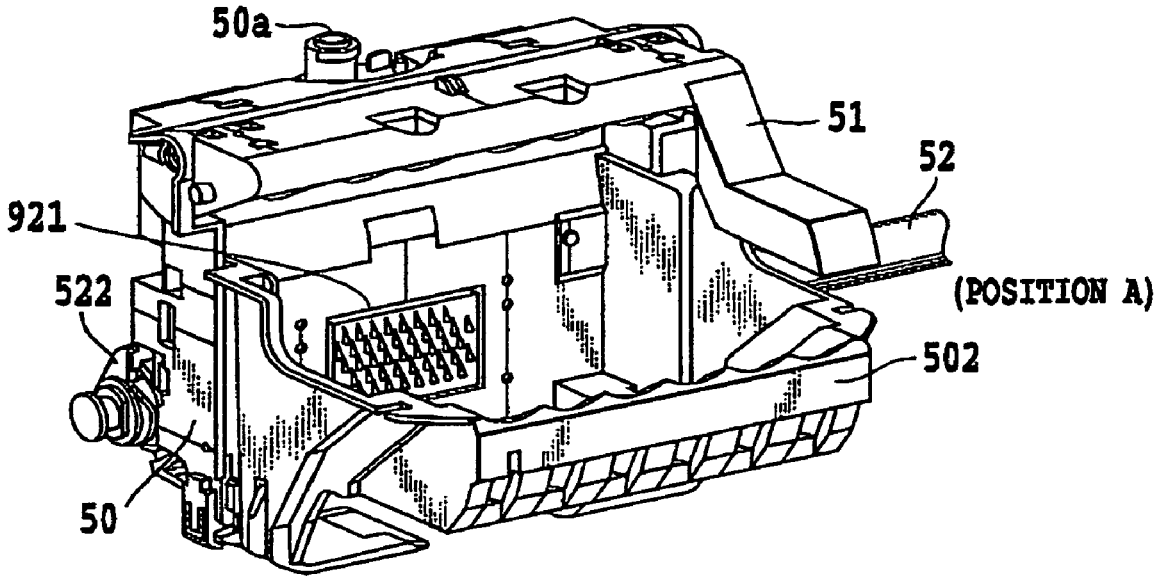
FIG. 26 is an explanatory perspective view showing the carriage lift mechanism in the thick paper printing state in the first embodiment of the invention.
Figure 27:
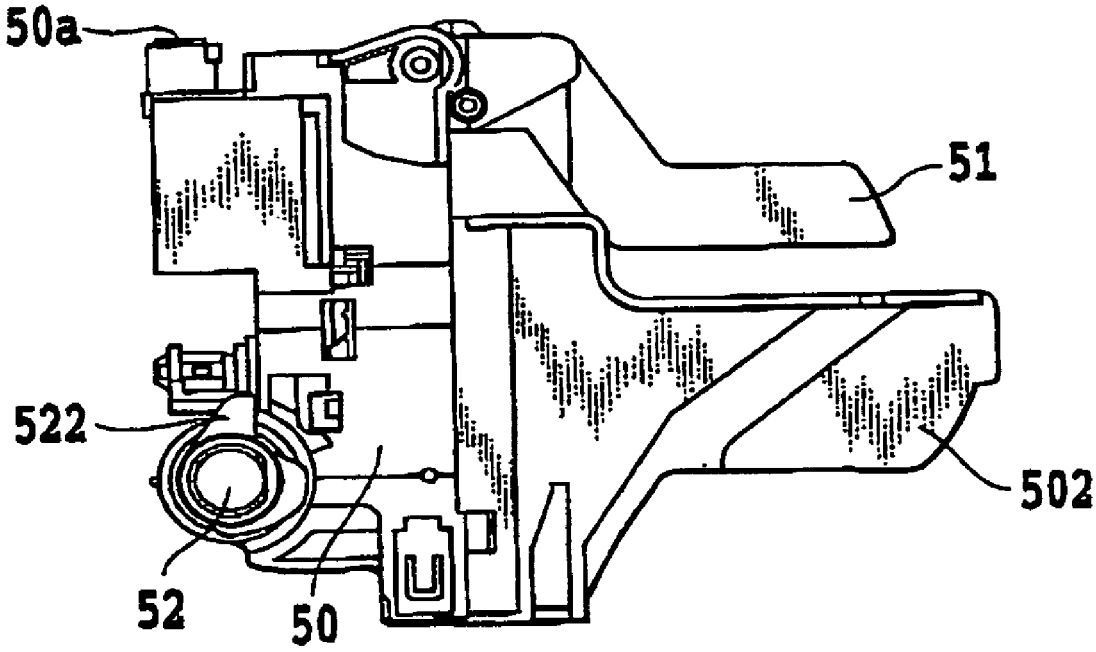
FIG. 27 is a side view of FIG. 26.
Figure 28:
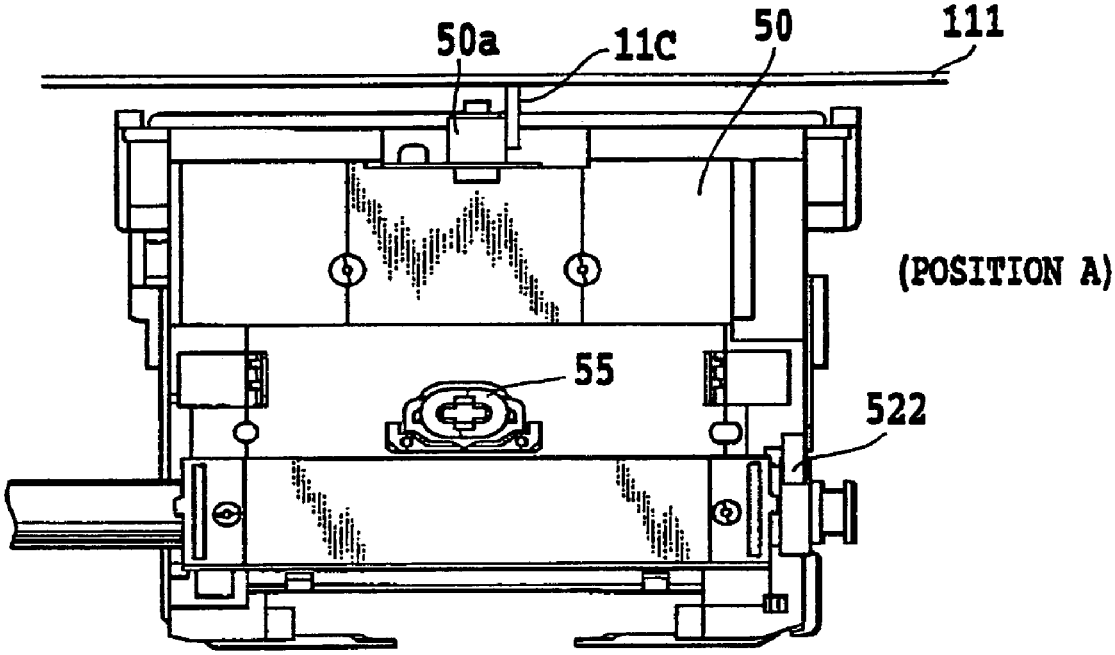
FIG. 28 is a rear view of FIG. 26.
Figure 29A:
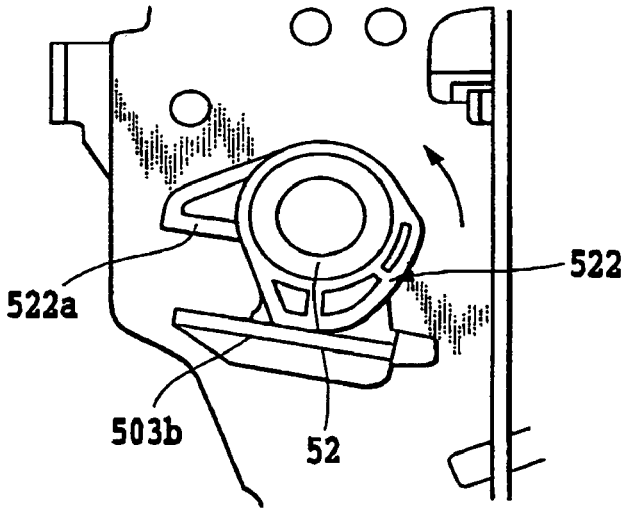
FIGS. 29A and 29B are explanatory side views showing the carriage lift mechanism in a CD printing state in the first embodiment of the invention.
Figure 29B:
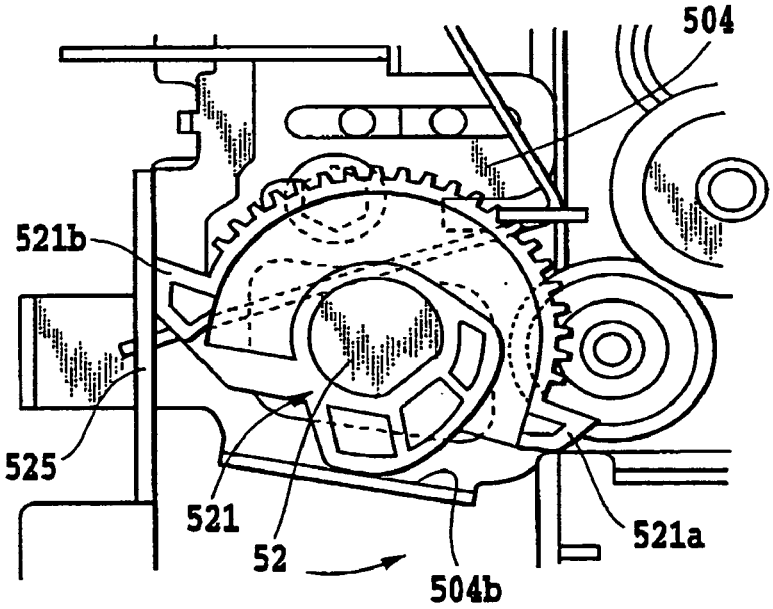
Figure 30:
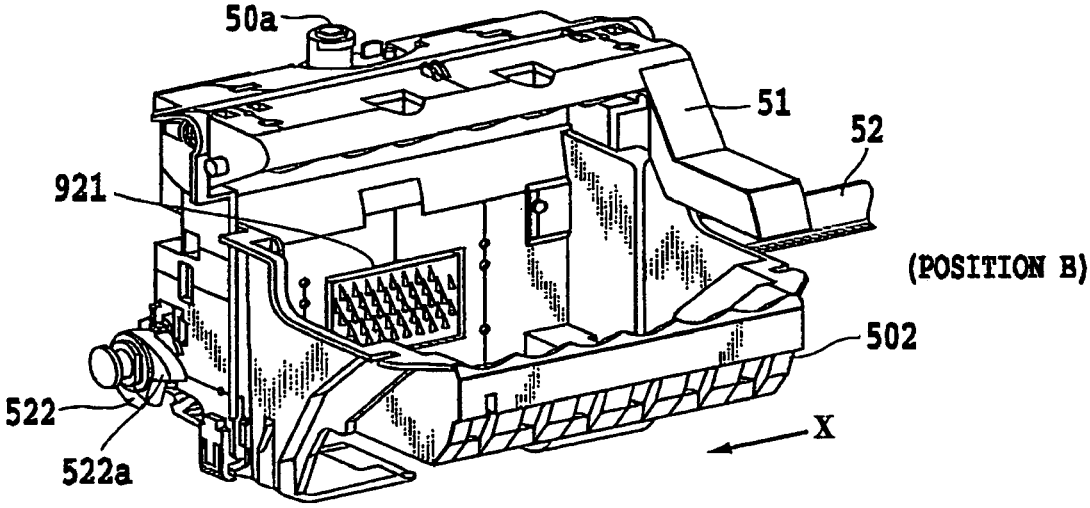
FIG. 30 is an explanatory perspective view showing the carriage lift mechanism in the CD printing state in the first embodiment.
Figure 31:
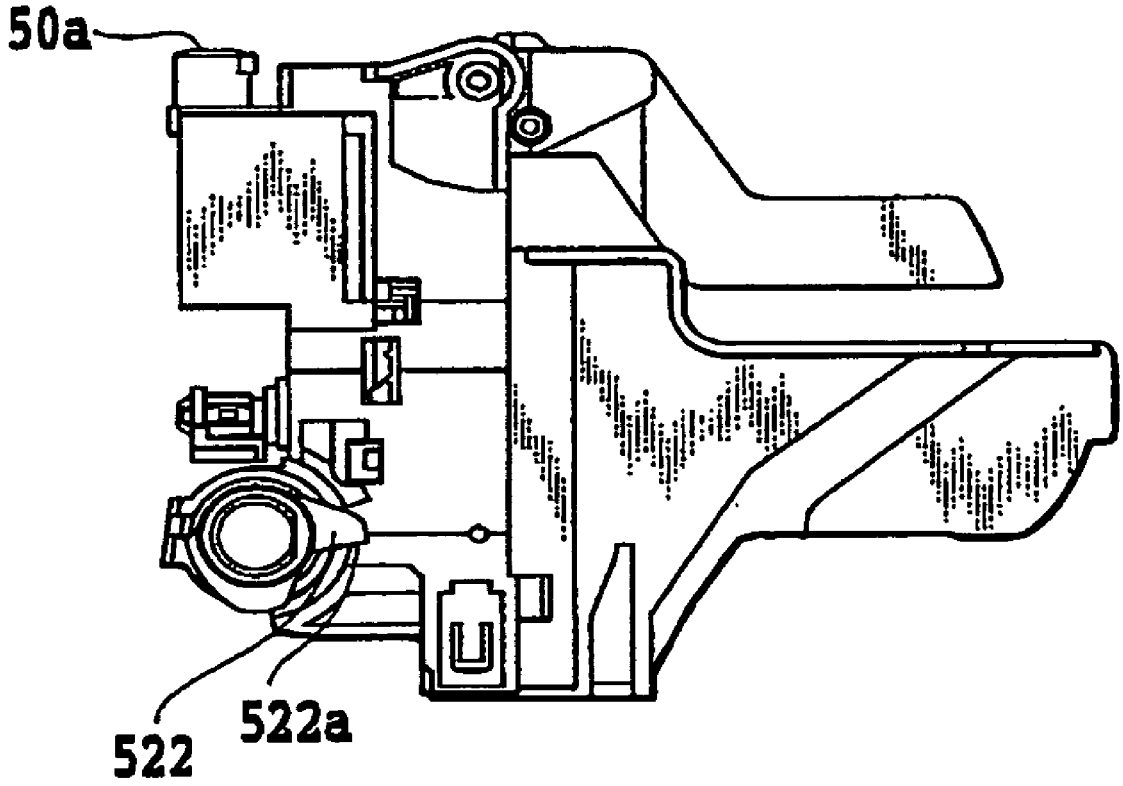
FIG. 31 is a side view of FIG. 30.
Figure 32:
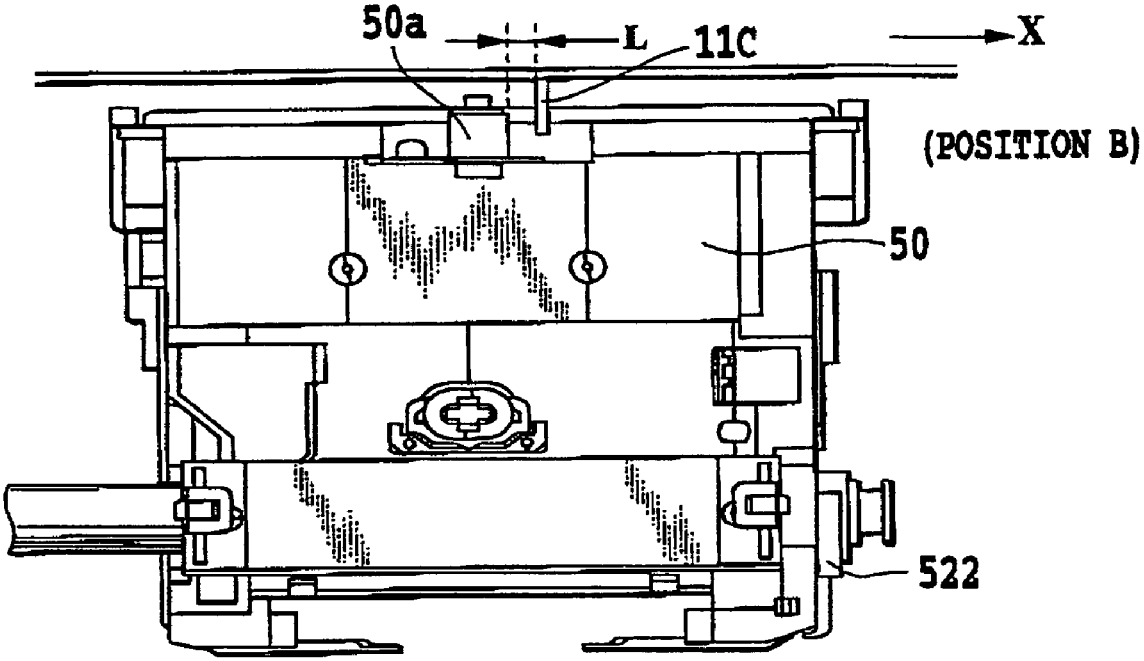
FIG. 32 is a rear view of FIG. 30.

FIG. 21A is a side view showing a normal printing state of the eccentric cam L 522 and FIG. 21B is a side view showing a normal printing state of the eccentric cam R 521. FIG. 22 to FIG. 24 show a positional relation of the eccentric cam L 522 when the carriage 50 is moved to the leftmost position in FIG. 3 and FIG. 4 when the eccentric cam L 522 and the eccentric cam R 521 are in the normal printing state. FIG. 25A is a side view of the eccentric cam L 522 when thick paper with a thickness of about 1 mm is printed, and FIG. 25B is a side view of the eccentric cam R 521 in the thick paper printing state. FIG. 26 to FIG. 28 illustrate a positional relation of the eccentric cam L 522 when the carriage 50 is moved to the leftmost position in FIG. 3 and FIG. 4 when the eccentric cam L 522 and the eccentric cam R 521 are in the thick paper printing state. FIG. 29A is a side view showing the eccentric cam L 522 when printing a CD, and FIG. 29B is a side view showing the eccentric cam R 521 in the CD printing state. FIG. 30 to FIG. 32 illustrate a positional relation of the eccentric cam L 522 when the carriage 50 is moved to the leftmost position in FIG. 3 and FIG. 4 when the eccentric cam L 522 and the eccentric cam R 521 are in the CD printing state.

First, the operation during the normal printing will be explained.

As shown in FIGS. 21A and 21B, the cam surfaces of the eccentric cam L 522 and the eccentric cam R 521 are both out of contact with the eccentric cam abutment faces 503*b*, 504*b* of the gap adjust plate L 503 and the gap adjust plate R 504. At this time, the guide shaft 52 is supported at their ends by the guide shaft support portions 503*a*, 504*a* and thereby positioned in the height direction to secure a gap that matches the normal printing state.

The eccentric cam R 521 is positioned in a rotary direction by engaging its rotation restriction portion 521*a* with a chassis abutment portion 525 of the chassis 11. In this state the carriage 50 is moved toward the left (in FIG. 3 and FIG. 4) until a slide piece 50*a* provided at the top of the carriage 50 abuts against a guide rail abutment portion 11*c* (see FIG. 24) provided on a guide rail 111 of the chassis 11. At this position A the carriage 50 does not abut against the eccentric cam L 522, as shown in FIG. 22.

Next, a thick paper printing operation is performed, as shown in FIG. 25A and 25B, by driving the carriage lift motor 58 to rotate the eccentric cam R 521 from the normal printing state shown in FIGS. 21A and 21B in a direction of the arrow (counterclockwise). Prior to the rotation of the eccentric cam R 521, the carriage 50 is moved to the position A shown in FIG. 26 and FIG. 28, i.e., until the slide piece 50*a* of the carriage 50 abuts against the guide rail abutment portion 11*c* of the guide rail 111. At this position A, when the eccentric cam L 522 provided at the left end of the guide shaft 52 is rotated in the direction of the arrow of FIG. 25, a rotation restriction portion L 522*a* of the eccentric cam L 522 engages in a vertical attitude with the carriage 50 as shown in FIG. 25A. Thus, a further rotation of the eccentric cam L 522 in the arrow direction shown in FIG. 29A and 29B is blocked. This in turn blocks the rotation of the guide shaft 52 and the eccentric cam R 521. In this case, the cam surfaces of the eccentric cam L 522 and the eccentric cam R 521 engage with the cam abutment faces 503*b*, 504*b* of the gap adjust plates L 503, R 504, setting the guide shaft 52 at a higher position than that for the normal printing shown in FIGS. 21A, 21B and FIGS. 22A, 21B.

Next, in a CD printing operation, the carriage lift motor 58 is driven further than in the thick paper printing operation, as shown in FIG. 29A and 29B. The rotation of the eccentric cam R 521 in the arrow direction is blocked when a rotation restriction portion 521*b* of the eccentric cam R 521 engages with the chassis abutment portion 525 of the gap adjust plate R 504. The guide shaft 52 now rests at a rotary position with the cam surfaces of the eccentric cams R 521, L 522 engaging with the cam abutment faces 503*b*, 504*b* of the gap adjust plates L 503, R 504. As a result, the guide shaft 52 is held at a height higher than those shown in FIG. 23 and FIG. 26.

In this CD printing state, the carriage 50 is blocked from moving in a direction of X in FIG. 30 (to the left in FIG. 3 and FIG. 4) by the rotation restriction portion L 522*a* of the eccentric cam L 522. That is, during the CD printing operation, the movement of the carriage 50 in the X direction is shortened by a distance L when compared with those of the normal printing and thick paper printing operations. This position is indicated as a position B. In other words, the rotation restriction portion L 522*a* of the eccentric cam L 522 serves not only to block the rotation of the cam itself by its engagement with the carriage 50 but also to block the movement of the carriage 50 in the X direction.

(Control System)

Figure 33:
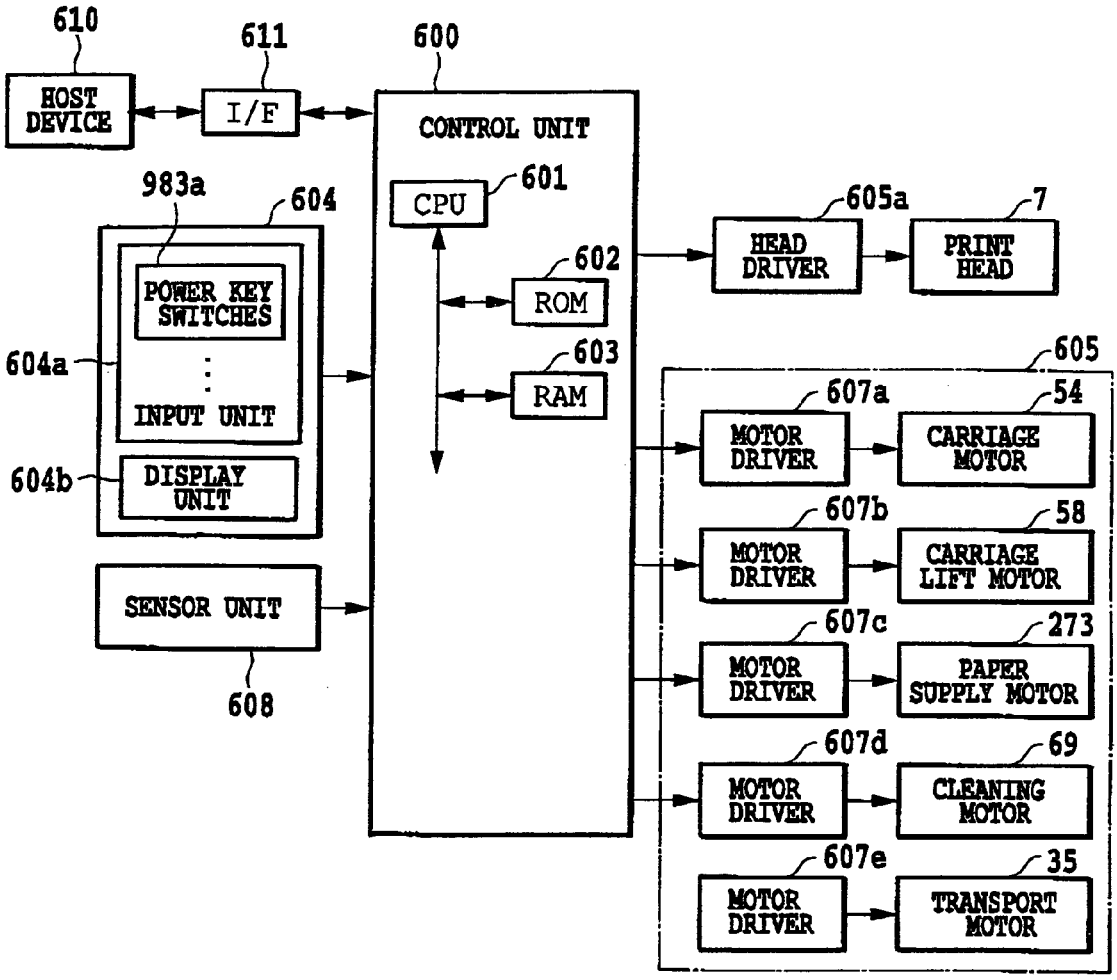
FIG. 33 is a block diagram showing an outline configuration of a control system in the first embodiment of the invention.

FIG. 33 shows an outline configuration of a control system of the ink jet printing apparatus of the above construction.

In the figure, designated 600 is a control unit as a control means for controlling various parts of the ink jet printing apparatus. The control unit comprises a CPU 601 as a means to perform a variety of calculations and controls and make decisions, a ROM 602 for storing a predetermined control program and data, and a RAM 603 for temporarily storing data and used as a work area by the CPU 601 during calculations.

The control unit 600 is connected to a host computer 610 as an external device through an interface 611 and also connected with an operation panel 604 by which to enter input commands, a head driver 605 to activate heaters in nozzles of a print head, a drive unit 607 to drive a variety of mechanisms described above, and a sensor unit 608 made up of various sensors described above to detect statuses of various parts of the apparatus.

The operation panel 604 has an input unit 604*a* with key switches, including power key switch 983*a*, for issuing a variety of commands and performing data input and a display unit 604*b* for displaying statuses of the apparatus.

A drive unit 607 has a variety of motors, such as a paper supply motor 273 as a drive source for supplying paper, a carriage motor 54 for scanning the carriage 50, a transport motor 35 for driving the transport roller 36, a cleaning motor 69 for the cleaning operation and a carriage lift motor 58 for raising or lowering the carriage 50, and also has motor drivers 607*a*–607*e* for driving these motors.

According to data sent from external devices such as the host computer and signals from the sensors, the control unit 600 performs control on the drivers 607*a*–607*e* and other components according to drive programs stored in the ROM 602 to execute a printing operation control (described later).

(Control Sequence for Printing Operation)

Next, a control sequence for the printing operation of the ink jet printing apparatus of the above construction will be described by referring to FIGS. 21A and 21B.

A first step to be performed after a power line of the ink jet printing apparatus is connected to an AC supply is to execute a first initialization of the apparatus at step S1. This initialization checks an electric circuit system, including the ROM and RAM of the apparatus, to confirm that the apparatus is electrically normal. This first initialization does not execute processing on the drive mechanism of the printing apparatus 1.

Next, at step S2, it is checked whether the power key switch 983*a* on the upper case 98 is turned on. If the power key switch 983*a* is found to be pressed, the control moves to the next step S3 where it executes a second initialization.

In the second initialization at step S3, various drive mechanisms in the apparatus and the head system are checked. That is, this step performs initialization of motors and various mechanisms connected to the motors and checks, by reading head information, whether the apparatus is normally operable.

Next, at step S4, the control waits for a variety of events in the printing apparatus. That is, this step monitors an instruction event from an external interface, a panel key event from user operation and an internal control event, and executes processing according to the event. The panel key event from user operation includes a power off operation using the power key switch 983*a*, a head cleaning operation by a resume switch 983*b*, and a cancel of the printing operation.

At step S4, when the control receives a print command event from an external I/F, it moves to step S5. When at step S4 a power key event from a user operation occurs, the control moves to step S200 where it terminates the printer operation. If at step S4 other events occur, it moves to step S300 and performs the associated event processing.

When, upon receipt of a print command as an event, the control moves to step S5, it analyzes the print command from the external I/F to determine a kind of paper, paper size, print quality and paper supply method specified. It then stores data representing these check results in the RAM of the apparatus before moving to step S511 of FIG. 21A.

Figure 35:
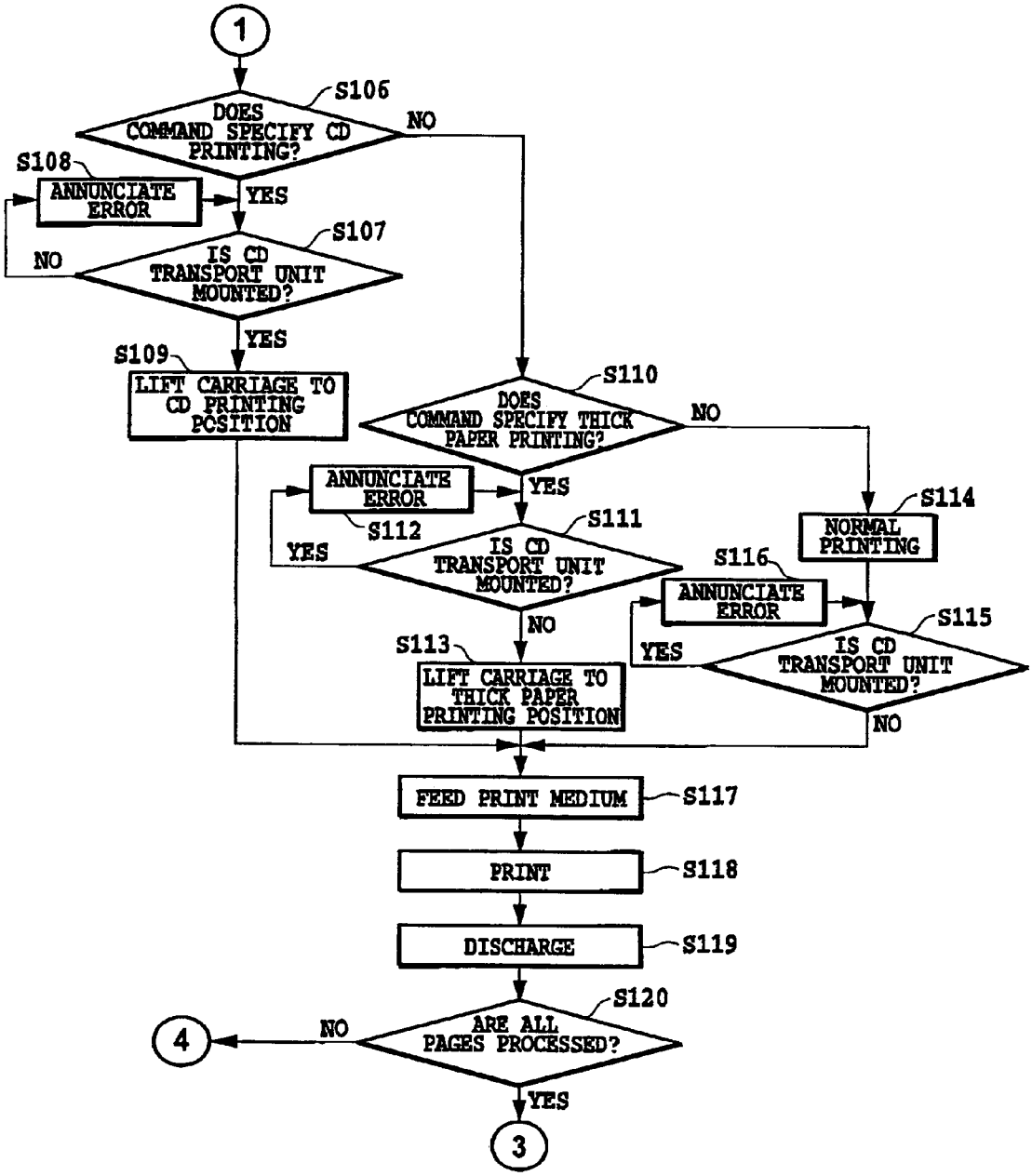
FIG. 35 is a flow chart showing a sequence of steps for controlling the printing operation of the ink jet printing apparatus in the first embodiment.

In steps S106–S115 shown in FIG. 35 a check is made as to whether the printing apparatus 1 is in a state suited for the specified paper supply method. In this first embodiment, for the CD printing operation, the CD-R transport unit 8 is mounted to the printing apparatus to feed the tray 83 from the CD-R transport unit 8, whereas for the thick paper printing and normal printing operations, print media are supplied from an automatic sheet feeder (ASF). Further, in this embodiment, prior to moving to step S106, the carriage 50 is in the normal printing state shown in FIG. 21.

At step S106 it is checked whether the specified printing is CD printing or other printing. If step S106 determines that the specified printing is the CD printing, the processing moves to step S107 where it checks a result of detection by a tray guide sensor 344 of FIG. 11 to see if the CD transport unit 8 of FIG. 8 is mounted to the printing apparatus 1. If the CD transport unit 8 is not found to be mounted to the printing apparatus 1, the processing moves to step S108 where it annunciates (indicates or alerts of) an error and waits for the CD transport unit 8 to be mounted.

If step S107 decides that the CD transport unit 8 is mounted, the processing proceeds to step S109 where it drives the carriage lift motor 58 to lift the carriage 50 to a CD printing state shown in FIG. 25A and FIG. 25B. Before driving the carriage lift motor 58, the carriage 50 is moved to where the print head 7 mounted on the carriage 50 opposes the cap 61 of FIG. 3 and FIG. 4. Then the lift motor 58 is activated. At the position where the print head 7 faces the cap 61, the carriage 50 is not engaged with the eccentric cam L 522 or the chassis right-side plate 11*a*. After the carriage 50 is lifted, the processing moves to step S117 where it selects and executes the tray feeding from the CD transport unit 8.

If step S106 decides that the received printing command does not specify the CD printing, the processing moves to step S110 where it checks whether the demanded printing operation is a thick paper printing. If it is determined that the thick paper printing is requested, the processing moves to step S111 and checks whether the CD transport unit 8 is mounted on the printing apparatus 1. If the CD transport unit 8 is found mounted, since this state is not suitable for the thick paper printing which is what needs to be executed, the processing proceeds to step S112 to annunciate an error and then waits until the CD transport unit 8 is dismounted. If at step S111 the CD transport unit 8 is found not mounted, the processing moves to step S113 where it drives the lift motor 58 to lift the carriage 50 to the thick paper printing state shown in FIG. 25A and FIG. 25B. Prior to the driving of the lift motor 58 in this step S113, the carriage 50 is moved to the leftmost position A shown in FIG. 24. Then the lift motor 58 is activated. At this time, since the rotation restriction portion L 522*a* of the eccentric cam L 522 provided at the left end of the guide shaft 52 abuts against the carriage 50, the rotation of the lift motor 58 is stopped at this position which represents the thick paper printing state. With the printing apparatus 1 in a state suited for the thick paper printing, the processing moves to step S117 and starts feeding thick paper from the ASF as demanded.

If step S110 decides that the requested printing operation is not the thick paper printing, the processing moves to step S114. In this embodiment it is determined that the requested printing is a normal printing. The processing proceeds to step S115 where it checks if the CD transport unit 8 is mounted to the printing apparatus 1. If the CD transport unit 8 is found mounted, the processing moves to step S116 to annunciate an error and waits until the CD transport unit 8 is dismounted. If at step S115 it is decided that the CD transport unit 8 is not mounted, the processing moves to step S117 where it starts feeding plain paper from the ASF, as in the case with the thick paper printing.

As described above, according to the print command received, a check is made as to whether the CD transport unit 8 is mounted to the printing apparatus and the gap of the carriage 50 or print head 7 is set to an optimum state, followed by the paper feeding at step S117 and the execution of the printing operation at step S118. In this printing operation, print data transmitted from an external I/F is temporarily stored in a print buffer. Then, the carriage motor 54 is driven to move the carriage 50 in the scan direction and at the same time the print data stored in the print buffer is supplied to the print head 7 to execute the printing of one line. With one line of print data printed, the transport motor 35 is activated to drive the transport roller 36 to feed the print medium such as paper in the subscan direction. Then, the above sequence of operations is repeated until one page of print data supplied through the external I/F is printed, at which time the processing proceeds to step S119.

At step S119 the transport motor 35 is operated to drive the discharge rollers 40, 41 until the print medium is determined to be discharged completely out of the printing apparatus. As a result, the print medium such as paper is discharged on the discharge tray 46 or the tray guide 82 of the CD transport unit 8. Next, at step S120, it is checked whether all the pages that need to be printed have been printed. If there is a page to be printed, the processing returns to step S105. Then, the previous steps S106–S120 are repeated until all the pages are printed, after which the processing moves to step S104 where it awaits another event.

Next, referring to FIG. 36 to FIG. 40, we will describe processing for initializing the lift mechanism for the carriage 50 of this embodiment and also processing to check if the lift mechanism operates normally.

Figure 36:
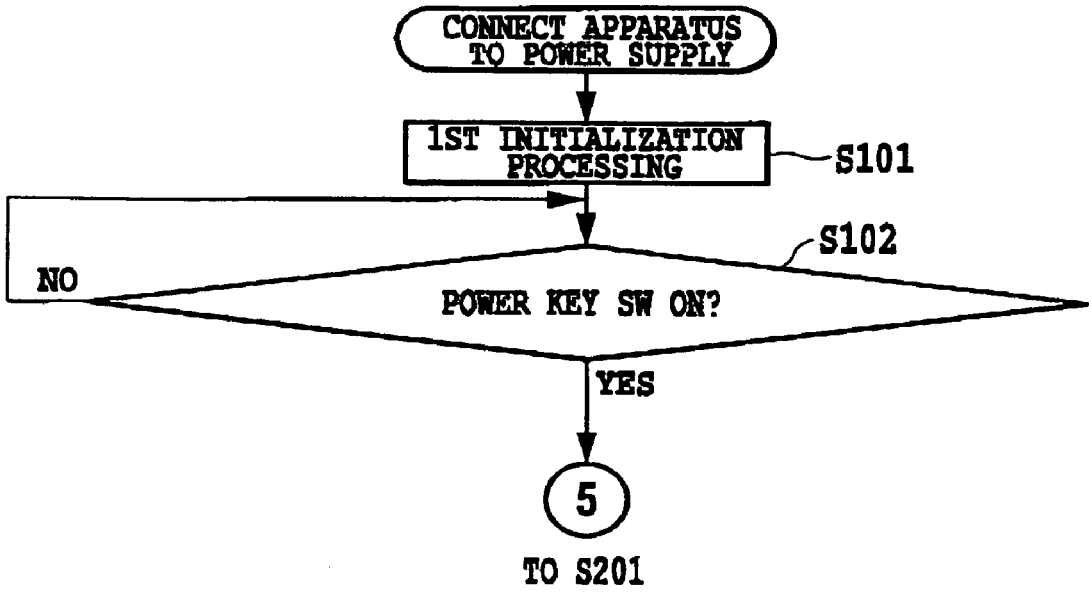
FIG. 36 is a flow chart showing a part of initialization processing of the ink jet printing apparatus in the first embodiment.

Referring to a flow chart of FIG. 36, second initialization processing at step S103 in FIG. 34 will be described in more detail. Here, the operation flow is shown centering on the control operation of the lift mechanism.

Figure 34:
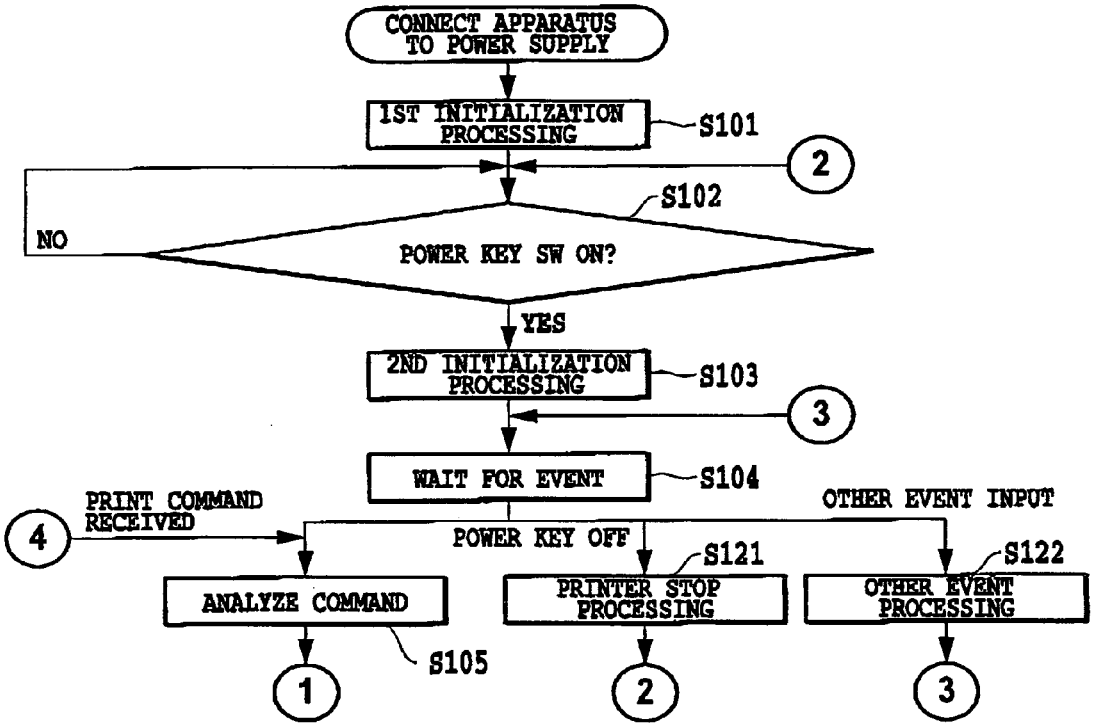
FIG. 34 is a flow chart showing a sequence of steps for controlling a printing operation of the ink jet printing apparatus in the first embodiment.

In step S101 and S102, the printing apparatus is connected to AC power to perform a first initialization, as in FIG. 34. This is followed by a second initialization beginning with step S201.

Next, at step S201 a check is made to determine in what state the printing apparatus was stopped before a power switch is turned on. This check is made based on information written into an EEPROM (not shown) mounted in the printing apparatus to decide whether the printing apparatus was stopped in an abnormal condition, or it was stopped by pulling off a power plug, or it was stopped normally. In this embodiment, when the printing operation is ended, a state of the apparatus at that time is written into the EEPROM.

In this embodiment, an abnormal end refers to a situation in which an error occurred during the operation of the printing apparatus and the operation was ended by pulling out a power cord from an outlet. In this case, the carriage 50 is situated at an indefinite position in the printing apparatus.

A normal end refers to a situation in which no errors occurred with the printing apparatus and the carriage 50 is situated opposite a cap position, with the ink ejection portion 701 of the print head 7 on the carriage 50 covered with the cap 61.

At step S201, it is checked whether the turn-on operation specified by the power key is preceded by an abnormal operation end or power cord disconnected operation end, or a normal operation end. If it is found that the turn-on operation follows an abnormal operation end or power cord disconnected operation end, the processing moves to step S203 where it checks whether the CD transport unit 8 is mounted to the printing apparatus 1.

Here, if the CD transport unit 8 is found mounted, the processing proceeds to step S204 where it initializes the cleaning unit 6 and then opens the cap 61 from the carriage 50 or the print head 7 mounted on the carriage 50.

Next, the carriage lift motor 58 is driven to raise the carriage 50 to the CD printing state shown in FIG. 29. The reason that the carriage 50 is lifted to the CD printing state is that there is a possibility of the tray 83 having been loaded from the CD transport unit 8 into the printing apparatus, that in this state the tray seat 831 of the tray 83 cannot be clamped by the transport roller 36 and the pinch roller 37 and that the tray seat 831 of the tray 83 may be protruding vertically. Thus, putting the carriage 50 in the CD printing state can prevent the print head from coming into contact with the tray 83 even when the carriage 50 is moved in the main scan direction (X direction) in the subsequent processing.

Next, at step S206 the carriage 50 is moved a predetermined distance, for instance about 5 mm, in a direction opposite the X direction of FIG. 3. This prevents the eccentric cam L 522 from being stopped at the thick paper printing state of FIG. 25, unable to further rotate to a position of the CD printing state, as it would be if the carriage 50 is situated at the leftmost position in FIG. 3 (position A in FIG. 26).

Then, the processing proceeds to step S207 where it drives the carriage lift motor 58 again for confirmation to put the carriage 50 in the CD printing state. After this, at step S208 the carriage 50 is engaged with the chassis right-side plate 11*a* of FIG. 3 to obtain a temporary reference position. The acquisition of the reference position by this engagement action is done because a reference position is required for managing the moving position of the carriage 50 in the subsequent processing. The reason that the acquired reference position is taken as a temporary reference position is that, in this embodiment, in the CD printing state the ends of the code strip 561 are fixed and lifted by the carriage 50. That is, a reference position acquired with the ends of the code strip 561 lifted does not precisely agree with a reference position for the normal printing state and therefore the acquired reference position is taken as a temporary reference position.

Next, the processing proceeds to step S209 and, according to the temporary reference position, moves the carriage 50 to a cap position where it opposes the cap 61. At the next step S210 the carriage lift motor 58 is driven to put the lift mechanism in the normal printing state of FIG. 21. At step S211 the reference position of the carriage 50 is acquired again and is taken as a final reference position of the carriage 50. Next, the processing proceeds to step S212 where it moves the carriage 50 to the cap position and then at step S213 initializes the paper supply unit (ASF) 2 and the paper transport unit 3. After this, the processing for confirming the operation of the lift mechanism of the carriage 50 is executed at step S214. Then at step S215 an ink volume in the ink tank 71 of the print head 7 mounted on the carriage 50 is detected. Now, a series of initialization steps is ended and the processing waits for another event (step S104).

If at step S203 the CD transport unit 8 is found not mounted, the processing moves to step S216 where it initializes the cleaning unit 6 and opens the cap 61. Then at step S217, the carriage 50 is moved about 5 mm to the right as in the preceding step S206. The processing then moves to step S210 and executes the subsequent steps up to step S215, after which it waits for another event (step S104).

Figure 38:
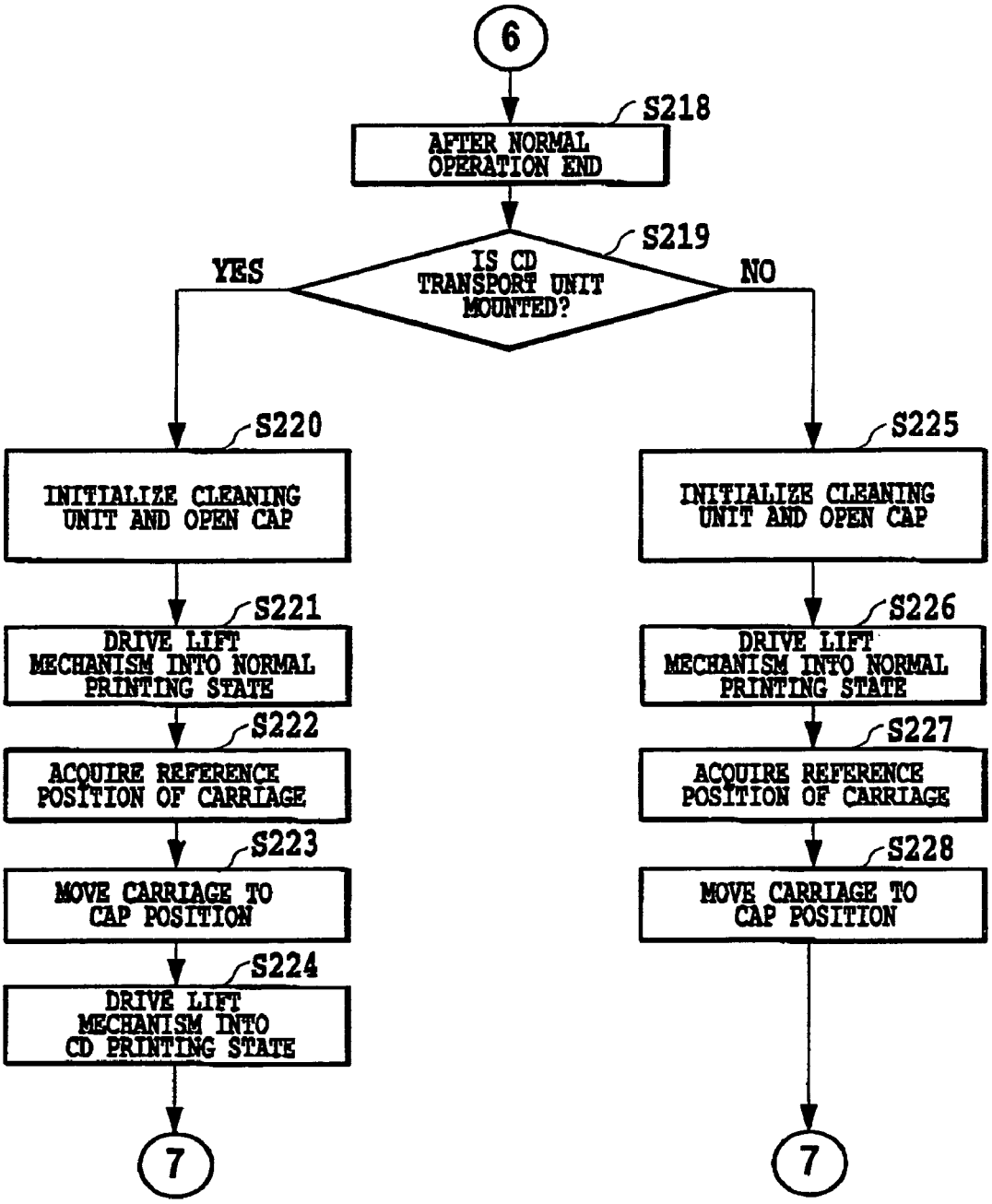
FIG. 38 is a flow chart showing a part of the initialization processing of the ink jet printing apparatus in the first embodiment.

If at step S201 the turn-on operation is preceded by a normal operation end, the processing moves to step S218 shown in FIG. 38. If it is determined that the previous operation was normally ended, since the carriage 50 is definitely situated at the cap position, the processing performed is simplified compared with those for the abnormal operation end or power cord disconnected operation end.

That is, at step S219 following step S218 the mounting state of the CD transport unit 8 is checked. If the CD transport unit 8 is found mounted, the processing moves to step S220 where it initializes the cleaning unit and opens the cap. Next at step S221 the lift motor 58 is driven to put the lift mechanism in the normal printing state shown in FIG. 21. Then at step S222 the reference position of the carriage 50 is acquired and at step S223 the carriage 50 is moved to the cap position. This is followed by step S224 that drives the lift motor 58 to put the lift mechanism in the CD printing state shown in FIG. 29. Now, the processing waits for another event (step S104).

If at step S219 it is decided that the CD transport unit 8 is not mounted, the processing moves to step S225. The processing from step S225 to step S228 is similar to that of step S220 to step S223. In this processing, however, since the CD transport unit 8 is not mounted to the printing apparatus 1, the processing does not drive the lift motor 58 but instead waits for another event in the normal printing state realized by step S226 (step S104).

(Confirmation of Operation of Carriage Lift Mechanism)

Figure 37:
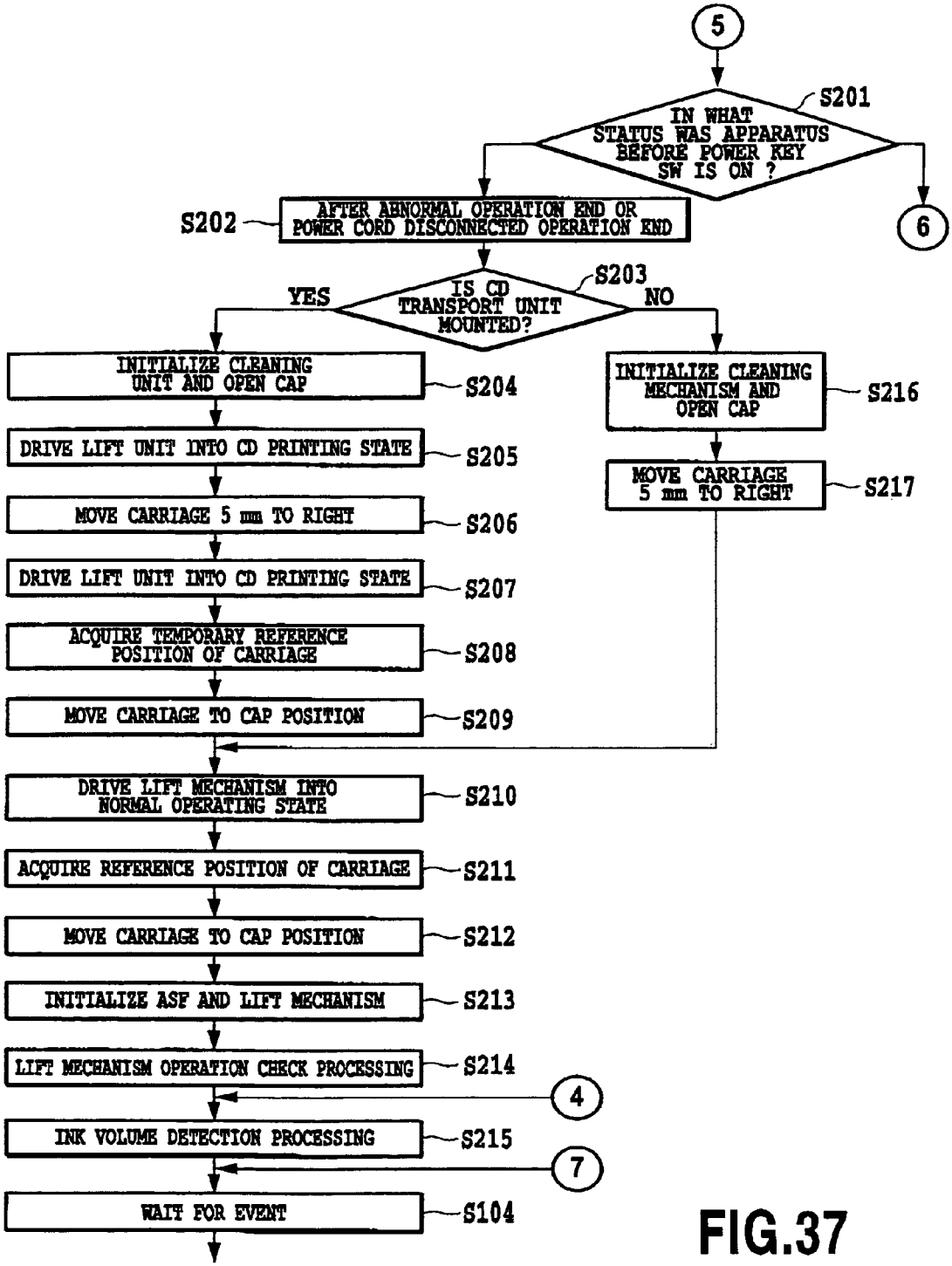
FIG. 37 is a flow chart showing a part of the initialization processing of the ink jet printing apparatus in the first embodiment.
Figure 39:
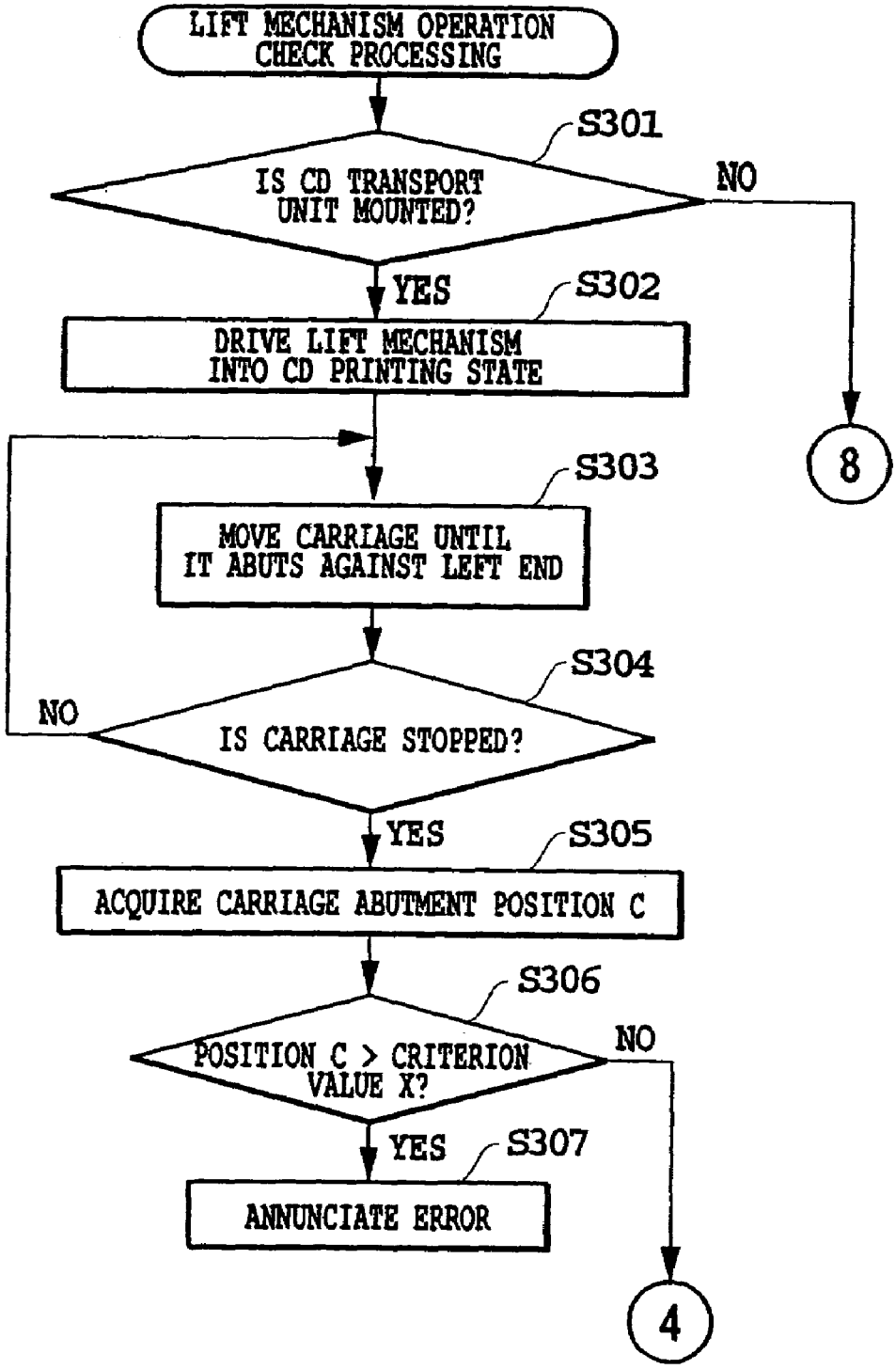
FIG. 39 is a flow chart showing a part of a carriage lift mechanism operation check processing in the initialization processing of the ink jet printing apparatus in the first embodiment.

A procedure to check the operation of the lift mechanism of the carriage 50, executed in the second initialization processing shown in FIG. 36 to FIG. 38, will be described in detail by referring to FIG. 39.

In the carriage lift mechanism operation check processing, first at step S301 the mounting state of the CD transport unit 8 on the printing apparatus 1 is checked again. If the CD transport unit 8 is found mounted, at step S302 the lift motor 58 is driven to put the lift mechanism in the CD printing state. Next, at step S303 the carriage 50 in the CD printing state (lifted state) is moved in the X direction (toward left) of FIG. 3 until the carriage 50 abuts against the guide rail abutment portion 11*c* or eccentric cam L 522 provided at the left side of the chassis 11. Next, at step S304 the movement of the carriage 50 is monitored by the code strip 561 and the encoder sensor (not shown). If it is decided that the carriage 50 has stopped, the processing moves to step S305 where it acquires a position of the stopped carriage 50 as an abutment position c. The abutment position c is a position of the carriage 50 after the carriage in the CD printing state has moved to the leftmost position. After the abutment position c is acquired, it is checked at step S306 whether the current state is the CD printing state. Here, if comparison between the abutment position c of the carriage 50 acquired at step S305 and a predetermined criterion value X finds that the abutment position c is larger than the criterion value X, i.e., if it is decided that the carriage 50 is situated more to the left than the position represented by the criterion value X, then an error is annunciated.

That is, if the lift mechanism including the lift motor 58 is working normally, the abutment position c of the carriage 50 in the CD printing state (the leftmost position to which the carriage 50 can be moved) shown in FIG. 32 is situated more toward the right opposite the X direction than the carriage abutment positions of the normal printing state and thick paper printing state. Using the position A at the leftmost position of the carriage 50 in the normal printing state and the thick paper printing state shown in FIG. 22 and FIG. 26 and the position B at the leftmost position of the carriage 50 in the CD printing state shown in FIG. 30, the criterion value X is set to X=(position A+position B)/2 and a check is made as to whether a relation: position c>criterion value X holds.

If at step S306 the above relation holds, it follows that the movement of the carriage 50 toward the left (X direction) is not restricted by the eccentric cam L 522. As a result, it is decided that the lift mechanism including the lift motor 58 is not working normally and at step S307 an error state is annunciated. If at step S306 the above relation does not hold, this means that the movement of the carriage 50 is restricted by the eccentric cam L 522 and it is decided that the lift mechanism is working normally. Thus the processing proceeds to step S215 shown in FIG. 37.

Figure 40:
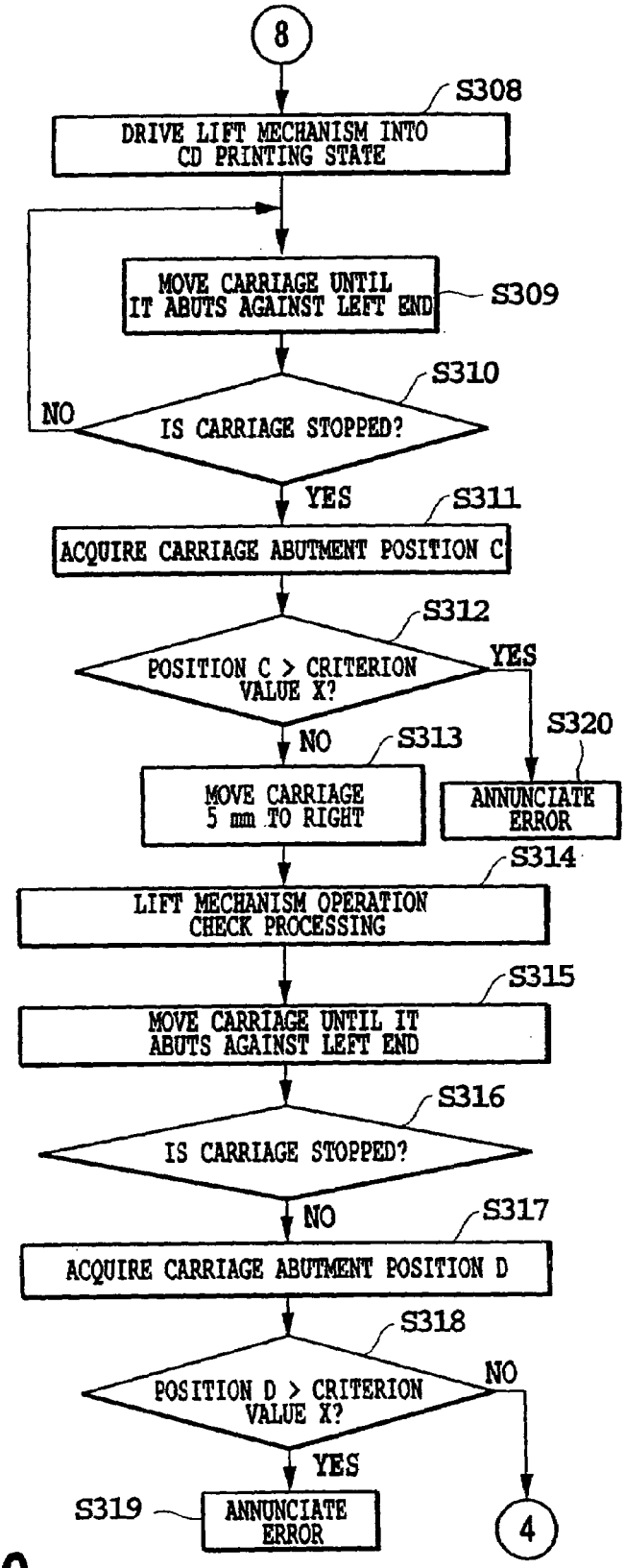
FIG. 40 is a flow chart showing a part of the carriage lift mechanism operation check processing in the initialization processing of the ink jet printing apparatus in the first embodiment.

If on the other hand step S301 decides that the CD transport unit 8 is not mounted to the printing apparatus 1, steps S308 to S320 shown in FIG. 40 are executed. This control operation also checks the leftmost position of the carriage 50 in the normal printing state as well as the leftmost position to which the carriage 50 in the CD printing state can be moved.

That is, steps S308 to S312 and step S320 perform checks in the CD printing state as in the preceding steps S301–S307. If at step S313 it is determined that the leftmost position c to which the carriage 50 in the CD printing state can be moved is smaller than the criterion value X and that the lift mechanism is working normally, the processing proceeds to step S313.

At step S313 the carriage 50 is temporarily moved 5 mm toward a direction opposite the X direction of FIG. 3. This is intended to part the carriage 50 from the eccentric cam L 522 to ensure smooth rotation of the eccentric cam L 522 driven by the lift motor 58 in the following step.

Then at step S314 the lift motor 58 is driven to set the lift mechanism to the normal printing state as shown in FIG. 21. At step S315 and step S316, the carriage 50 is moved in the X direction (toward the left) until it abuts and stops. If step S315 confirms that the carriage 50 has stopped in an abutted state, the position of the carriage 50 at this time is acquired as a leftmost position d to which the carriage 50 in the normal printing state can be moved (step S317).

Step S318 checks whether the acquired position d satisfies the relation: position d<criterion value X. If this relation holds, it follows that the movement of the carriage 50 is restricted by the eccentric cam L 522 and it is therefore decided that the lift mechanism including the lift motor 58 is not working normally, resulting in an error annunciation at step S319.

If at step S317 the above relation does not hold, this means that the movement of the carriage 50 is not restricted by the eccentric cam L 522 and it is thus decided that the lift mechanism is working normally. The processing therefore moves to step S215 shown in FIG. 37.

As described above, in this embodiment of the ink jet printing apparatus having a lift mechanism as a means for changing the gap of the carriage 50, it is possible to optimize the gap between the print head and a print medium without providing a dedicated sensor for the control of the gap and also to immediately annunciate when any anomaly occurs with the lift mechanism.

Thus, not only can the cost of the ink jet printing apparatus be reduced but there is no need for a member to mount the sensor or a lead for its electrical connection, simplifying the inner construction of the apparatus, which in turn leads to a size reduction of the apparatus. Further, in this embodiment because a DC motor is used as a drive source for lifting the carriage, the construction is less costly than when other motors or drive sources are used. Since an encoder sensor for detecting the revolution and drive distance of the DC motor is not provided, a further cost reduction can be realized.

Further, since the lift mechanism operation check is not performed every printing operation but performed only when the printing apparatus is connected to a power supply, an overall time required for the printing operation can be shortened, realizing an excellent printing performance.

While in this embodiment a DC motor is used as a drive source for lifting the carriage, a pulse motor may also be used.

(Other Embodiments)

It is noted that the present invention is not limited to the construction of the first embodiment but can take a variety of other constructions as follows.

For example, while in the first embodiment the operation check on the carriage lift mechanism has been described in FIG. 36 to FIG. 40 to be performed only when a power cord of the printing apparatus is connected to a power supply, it is also possible to move the carriage 50 in the X direction (toward the left) until it is stopped by an abutment member, prior to the paper supply operation performed by step S117 of FIG. 35, and then to check the state of the gap changing means just before feeding a print medium. In this case, since the carriage 50 needs only to be moved in the X direction, the printing operation can be started with minimum processing. Moreover, whether the gap changing means is normal or abnormal can always be checked prior to printing.

Further, while in the first embodiment the gap changing mechanism for the carriage 50 has been described to vertically lift the carriage, the direction in which the carriage is moved to change the gap is not limited to the vertical direction and the only requirement is that the carriage is moved toward and away from the print medium transport path. That is, when the print medium transport direction is set to be vertical, the carriage can be moved horizontally toward and away from the print medium transport path.

The present invention has been described in detail with respect to preferred embodiments, and it will now be apparent from the foregoing to those skilled in the art that changes and modifications may be made without departing from the invention in its broader aspect, and it is the intention, therefore, that the appended claims cover all such changes and modifications as fall within the true spirit of the invention.

What is claimed is:

1. An ink jet recording apparatus which moves a carriage having a print head mounted thereon to eject ink from the print head onto a print medium, said ink jet recording apparatus comprising:

a platen for guiding a print medium at a position opposite to the print head;

a guide shaft for guiding movement of the carriage;

a carriage lift mechanism capable of lifting the carriage to a first position at which a distance to said platen is a first distance and a second position at which a distance to said platen is a second distance, said carriage lift mechanism performing the lifting by driving a motor;

a restriction portion abutting against the carriage when the carriage is at the second position, thereby changing a movement range of the carriage to be different from a movement range when the carriage is at the first position; and control means for judging whether or not said carriage lift mechanism normally operates by detecting the movement range of the carriage prior to supplying the print medium.

2. The apparatus according to claim 1, wherein a code strip is read by means of an encoder sensor disposed at the carriage, thereby detecting the movement range of the carriage.

3. The apparatus according to claim 1, wherein the carriage is moved to the first position during normal recording, and the carriage is moved to the second position during CD recording.

4. An ink jet recording method which moves a carriage having a print head mounted thereon to eject ink from the print head onto a print medium, the ink jet recording method comprising the steps of:

guiding a print medium with a platen at a position opposite to the print head;

guiding movement of the carriage with a guide shaft;

lifting the carriage with a carriage lift mechanism to a first position at which a distance to the platen is a first distance and a second position at which a distance to the platen is a second distance, by driving a motor;

providing a restriction portion for abutting against the carriage when the carriage is at the second position, thereby changing a movement range of the carriage to be different from a movement range when the carriage is at the first position; and judging whether or not the carriage lift mechanism normally operates by detecting the movement range of the carriage prior to supplying the print medium.

* * * * *